US007134456B2

(12) United States Patent
Maeda et al.

(10) Patent No.: US 7,134,456 B2
(45) Date of Patent: Nov. 14, 2006

(54) PIPE BODY, METHOD OF MANUFACTURING PIPE BODY, AND IMAGE FORMING APPARATUS USING THE PIPE BODY

(75) Inventors: Taiki Maeda, Machida (JP); Takafumi Kondoh, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 230 days.

(21) Appl. No.: 10/609,645

(22) Filed: Jul. 1, 2003

(65) Prior Publication Data

US 2004/0035166 A1 Feb. 26, 2004

(30) Foreign Application Priority Data

Jul. 1, 2002 (JP) ..... 2002-192631

(51) Int. Cl.
*F16L 9/02* (2006.01)

(52) U.S. Cl. ..... 138/156; 138/177; 138/151; 72/368; 72/51

(58) Field of Classification Search ..... 138/177, 138/178, 156, 151; 72/368, 51
See application file for complete search history.

(56) References Cited

U.S. PATENT DOCUMENTS 3,753,352 A * 8/1973 McNally ..... 405/43
5,660,212 A * 8/1997 Elder ..... 138/157
5,799,703 A * 9/1998 Kanao et al. ..... 138/121
6,076,992 A * 6/2000 Fukui et al. ..... 405/43
6,601,427 B1 * 8/2003 Kondou et al. ..... 72/368
2001/0013242 A1 * 8/2001 Kondou et al. ..... 72/379.2
2001/0020491 A1 9/2001 Kondou et al.
2004/0035166 A1 2/2004 Maeda et al.
2005/0122555 A1 6/2005 Kondoh et al.

FOREIGN PATENT DOCUMENTS

CN 2361405 2/2000
CN 1320498 11/2001
JP 2001-286934 10/2001

* cited by examiner

*Primary Examiner*—Patrick Brinson
(74) *Attorney, Agent, or Firm*—Oblon, Spivak, McClelland, Maier & Neustadt, P.C.

(57) ABSTRACT

A method of manufacturing a pipe body having a rectangular cross section, including preparing a metal plate having edges parallel to each other and bending lines parallel to the edges, forming malleable portions extending perpendicular to the bending lines, forming the metal plate into an intermediate product by bending at the bending lines such that the intermediate product includes a center bottom wall, adjoining walls, and two upper walls, applying external forces to the adjoining walls so as to expand and curve the center bottom wall outward, thereby bringing the edges in the upper walls into intimate contact, and applying external force to the curved center bottom wall so as to flatten the center bottom wall and maintain the edges in close contacted condition with a spring back force in the center bottom wall, wherein the malleable portions are formed in the adjoining walls.

11 Claims, 28 Drawing Sheets

PIPE BODY, METHOD OF MANUFACTURING PIPE BODY, AND IMAGE FORMING APPARATUS USING THE PIPE BODY

CROSS-REFERENCE TO RELATED APPLICATIONS

The present application claims priority to Japanese Patent Application No. 2002-192631 filed in the Japanese Patent Office on Jul. 1, 2002, the disclosure of which is incorporated herein by reference.

BACKGROUND OF THE INVENTION

1. Field of the Invention

The present invention relates to a method of manufacturing a pipe body by performing a bending operation on a metal plate, to a pipe body manufactured by the method, and to an image forming apparatus using the pipe body.

2. Discussion of the Background

A method of manufacturing a pipe body having a rectangular cross section has been proposed in a Published Japanese patent application 2001-286934. In the Published Japanese patent application 2001-286934, as illustrated in FIGS. 1A and 1B, an intermediate product 41 is formed by bending a metal plate 40 having a pair of edges 40*a* and 40*b* parallel to each other. As illustrated in FIG. 1B, the intermediate product 41 includes three walls 42, 43*a*, and 43*b* which construct the pipe body's walls except an upper wall. The upper wall is formed by joining the edges 40*a* and 40*b* to each other. Specifically, the wall 42 constructs a bottom wall of the pipe body, and the walls 43*a* and 43*b* construct side walls of the pipe body and adjoin the wall 42 (hereafter referred to as adjoining walls 43*a* and 43*b*). In the intermediate product 41, each angle θ1 formed between the wall 42 and the adjoining wall 43*a* or 43*b* is made obtuse, so that the edges 40*a* and 40*b* are away from each other.

Next, as illustrated in FIGS. 1C and 1D, external forces are applied to the adjoining walls 43*a* and 43*b*, and thereby the wall 42 is curved outward and the edges 40*a* and 40*b* are brought into intimate contact with each other. Then, referring to FIG. 1E, another external force is applied to the curved portion of the wall 42 while applying pressure to a surface 45 of the upper wall including a junction 44 of the edges 40*a* and 40*b*, and thereby the wall 42 is deformed to be flat. As a result, a pipe body 46 is obtained as a completed product.

In the above-described manufacturing method of a pipe body, a spring back force that maintains the edges 40*a* and 40*b* of the intermediate product 41 in close contacted condition remains at a surface 47 of the wall 42, allowing the edges 40*a* and 40*b* to closely contact each other without welding.

As described above, to flatten the wall 42 and to enhance the planarity of the surface 45 of the upper wall and the surface 47 of the wall 42, an external force is applied to the wall 42 while applying pressure to the surface 45. When applying an external force to the wall 42 while applying pressure to the surface 45, deformation such as buckling may occur on a surface 49 of the adjoining wall 43*a* and a surface 50 of the adjoining wall 43*b* in the pipe body 46. Such deformation may be caused by the following reasons: (1) the strength of the adjoining walls 43*a* and 43*b* against the external force is insufficient due to the uneven hardness of the material for the metal plate 40, and (2) the external force is excessively exerted when the bottom dead center position of a mold 48 pressing the surface 45 of the upper wall is lower than an assumed position due to the fluctuation of process conditions. The deformation may affect the quality of a product especially when the surfaces 49 and 50 are needed to be formed with accuracy and when holes are formed in the surfaces 49 and 50 with high accuracy. Accordingly, the quality inspection of products may be required.

However, the above-described deformation does not necessary occur constantly even in the same production lot. Therefore, when manufacturing products with high accuracy, the inspection of all completed products needs to be performed, thereby increasing the manufacturing cost of a pipe body.

Therefore, it is desirable to provide a manufacturing method of a pipe body in which the surfaces of the pipe body do not deform when external forces are applied thereto at the time of press process, thereby at least reducing inspection of a completed pipe body, and suppressing increase in manufacturing cost for a pipe body even with high accuracy.

SUMMARY OF INVENTION

According to one aspect of the present invention, a method of manufacturing a pipe body having a rectangular cross section includes preparing a metal plate having a pair of edges parallel to each other and a plurality of bending lines parallel to the pair of edges, forming at least one malleable portion extending in a direction perpendicular to the bending lines of the metal plate, forming the metal plate into an intermediate product by bending the metal plate at the plurality of bending lines such that the intermediate product includes a center bottom wall, first and second adjoining walls adjoining the center bottom wall, and two upper walls including the edges of the metal plate, respectively, the center bottom wall and first and second adjoining walls forming obtuse angles, respectively, the pair of edges in the two upper walls being spaced apart from each other, applying external forces to the first and second adjoining walls so as to expand and curve the center bottom wall outward, thereby bringing the pair of edges in the two upper walls into intimate contact with each other, and applying an external force to the curved center bottom wall so as to flatten the center bottom wall and maintain the edges in the two upper walls in close contacted condition with a spring back force in the center bottom wall, thereby forming a pipe body having a bottom wall, two side walls, and an upper wall, wherein the at least one malleable portion is formed in at least one of the first and second adjoining walls.

According to another aspect of the present invention, a method of manufacturing a pipe body having a rectangular cross section includes preparing a metal plate having a pair of edges parallel to each other and a plurality of bending lines parallel to the pair of edges, forming at least one malleable portion extending in a direction perpendicular to the bending lines of the metal plate, forming the metal plate into an intermediate product by bending the metal plate at the plurality of bending lines such that the intermediate product includes a center bottom wall, first and second adjoining walls adjoining the center bottom wall, and two upper walls including the edges of the metal plate, respectively, the center bottom wall and first and second adjoining walls forming obtuse angles, respectively, the pair of edges in the two upper walls being spaced apart from each other, applying external forces to the first and second adjoining walls while inhibiting the center bottom wall from expanding and curving outward, thereby flattening the center bottom wall and bringing the pair of edges in the two upper walls into intimate contact with each other, and pressing the two upper walls of the intermediate product in which the edges are in intimate contact with each other and the center bottom wall of the intermediate product, thereby forming a pipe body having a bottom wall, two side walls, and an upper wall, wherein the at least one malleable portion is formed in at least one of the first and second adjoining walls.

According to yet another aspect of the present invention, a method of manufacturing a pipe body having a rectangular cross section includes preparing a metal plate having a pair of edges parallel to each other and a plurality of bending lines parallel to the pair of edges, forming at least one malleable portion extending in a direction perpendicular to the bending lines of the metal plate, forming the metal plate into an intermediate product by bending the metal plate at the plurality of bending lines such that the intermediate product includes a center bottom wall, first and second adjoining walls adjoining the center bottom wall, and two upper walls including the edges of the metal plate, respectively, the center bottom wall and first and second adjoining walls forming substantially right angles, respectively, the pair of edges in the two upper walls being spaced apart from each other, applying external forces to the first and second adjoining walls while forming convex portions in the first and second adjoining walls, respectively, which protrude from the first and second adjoining walls toward an inner side of the pipe body, thereby bringing the pair of edges in the two upper walls into intimate contact with each other, and pressing the two upper walls of the intermediate product in which the edges are in intimate contact with each other and the center bottom wall of the intermediate product, thereby forming a pipe body having a bottom wall, two side walls, and an upper wall, wherein the at least one malleable portion is formed in at least one of the first and second adjoining walls.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
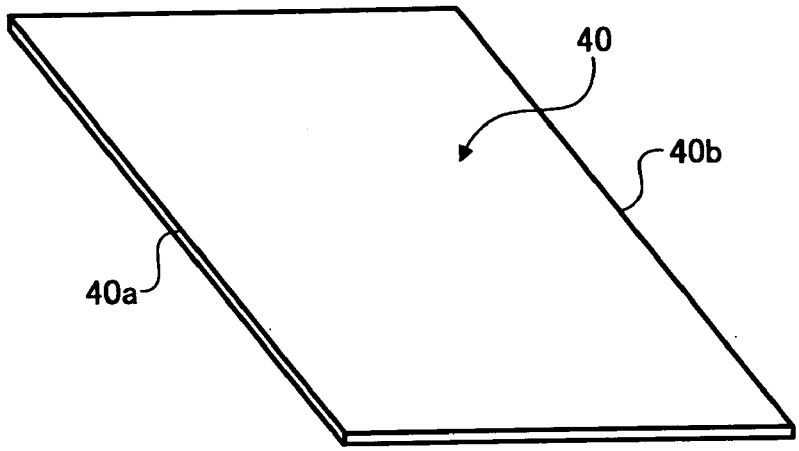
FIG. 1A is a schematic perspective view of a metal plate for explaining a method of manufacturing a background pipe body.
Figure 1B:
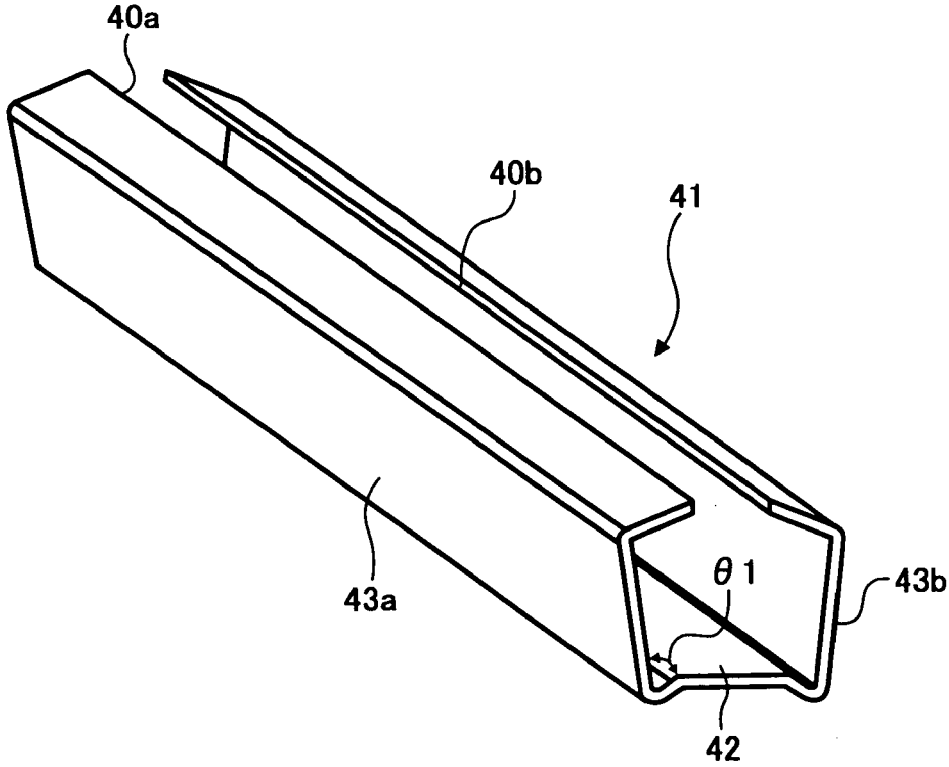
FIG. 1B is a schematic perspective view of an intermediate product formed by bending the metal plate of FIG. 1A.
Figure 1C:
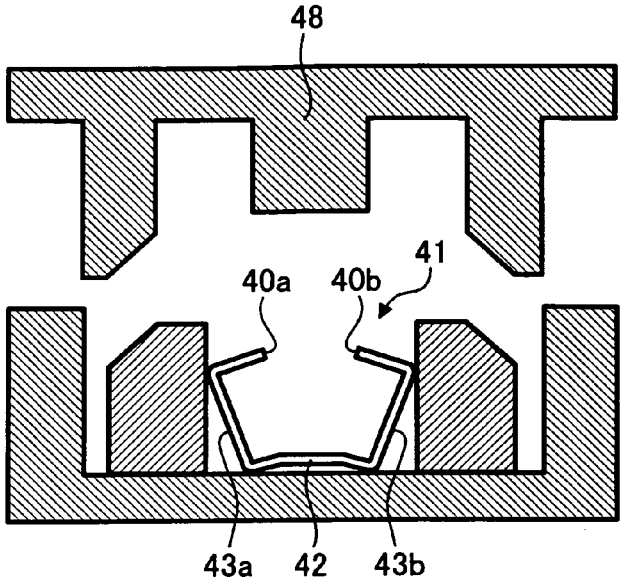
FIG. 1C is a schematic view showing a condition that the intermediate product of FIG. 1B is set in a press forming device.
Figure 1D:
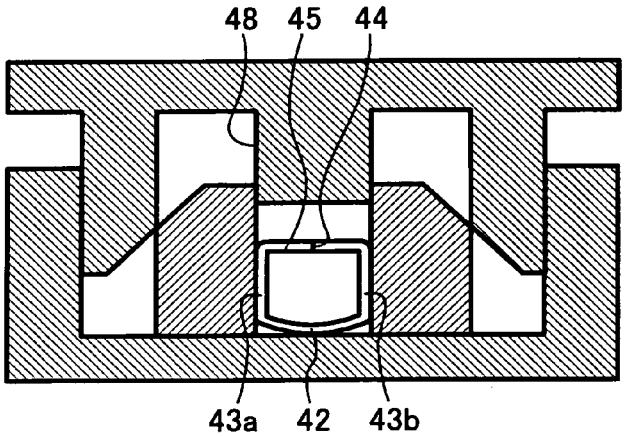
FIG. 1D is a schematic view showing a condition that the intermediate product is pressed from right and left sides.
Figure 1E:
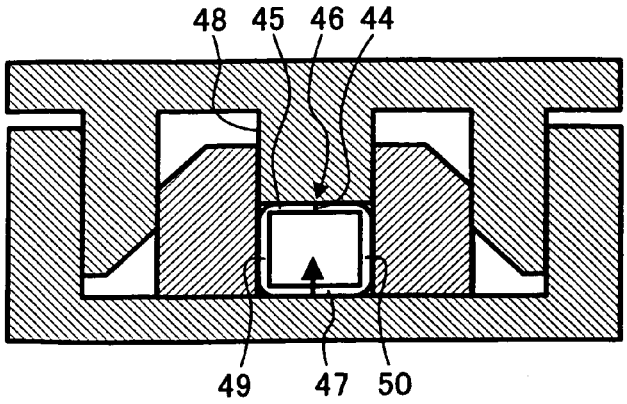
FIG. 1E is a schematic view showing a condition that the intermediate product is pressed from upper and lower sides.

Preferred embodiments of the present invention are described in detail referring to the drawings, wherein like reference numerals designate identical or corresponding parts throughout the several views.

Figure 2:
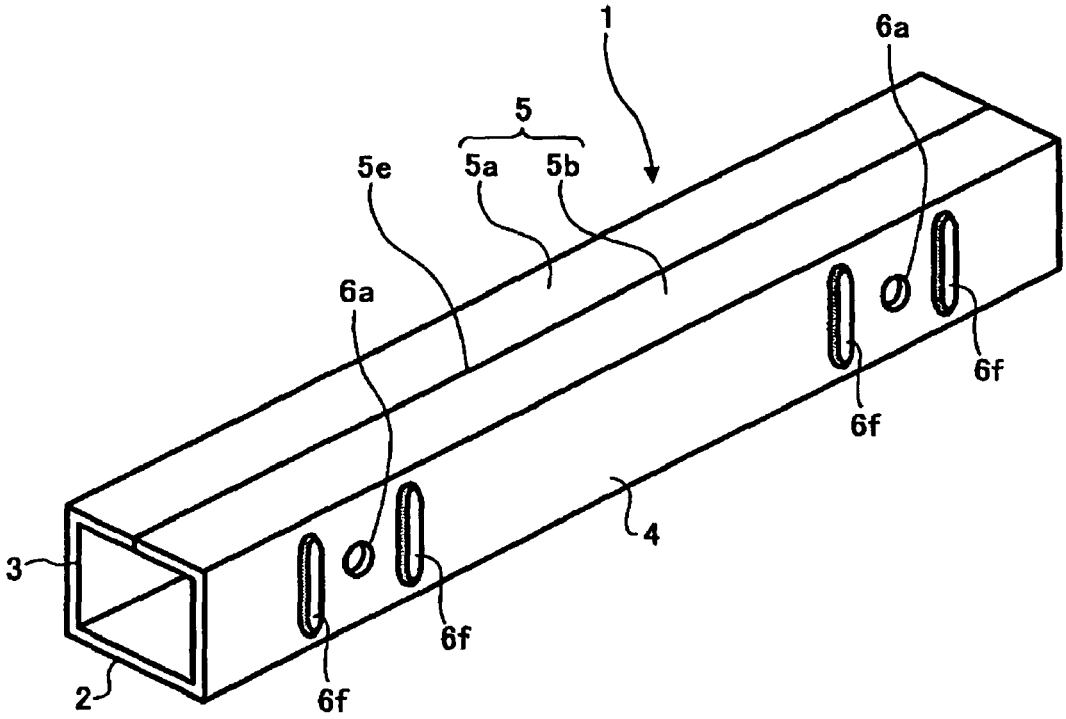
FIG. 2 is a schematic perspective view of a pipe body having a rectangular cross section for use in an image forming apparatus according to one embodiment of the present invention.
Figure 3:
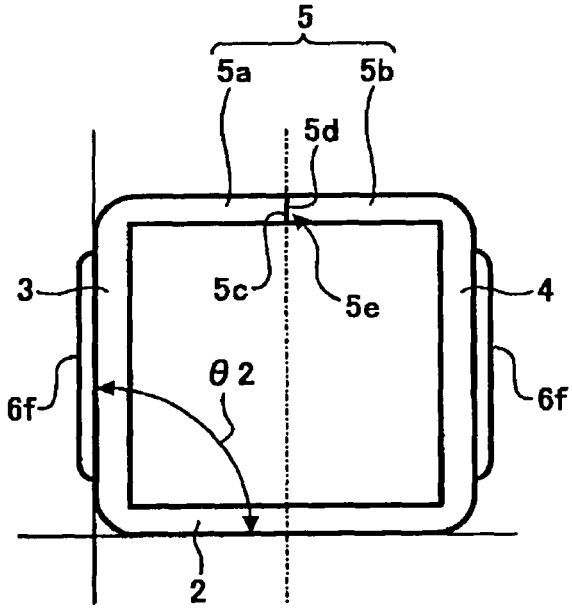
FIG. 3 is a side view of the pipe body of FIG. 2.

FIG. 2 is a schematic perspective view of a pipe body having a rectangular cross section for use in an image forming apparatus according to one embodiment of the present invention. FIG. 3 is a side view of the pipe body of FIG. 2. Referring to FIGS. 2 and 3, a pipe body 1 includes four walls which make four edges of the rectangular cross section of the pipe body 1 illustrated in FIG. 3. Specifically, the pipe body 1 includes a bottom wall 2, a pair of side walls 3 and 4 adjacent to the bottom wall 2, and an upper wall 5 that faces the bottom wall 2. The upper wall 5 includes a pair of walls 5*a* and 5*b* having end surfaces 5*c* and 5*d*, respectively. The two end surfaces 5*c* and 5*d* of the pair of walls 5*a* and 5*b* are in tight contact with each other such that a seam 5*e* is formed in the center of the upper wall 5.

Figure 4:
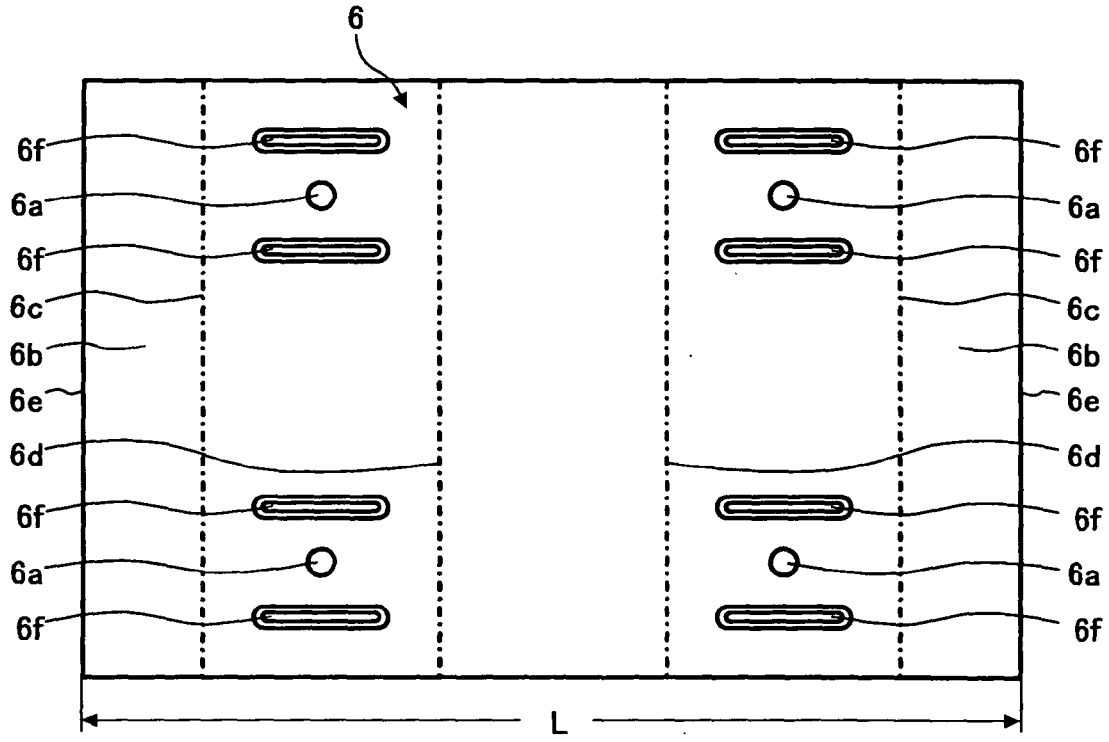
FIG. 4 is a plane view of a metal plate used for forming the pipe body of FIGS. 2 and 3.

A rectangular shaped metal plate 6 is used as a material for the pipe body 1 formed by pressing. As illustrated in FIG. 4, the metal plate 6 includes a pair of edges 6*e* which are parallel to each other. Any material may be used for the metal plate 6 so long as a material is suitable for malleable forming, such as, iron, copper, aluminum, and stainless steel. In the present embodiment, iron is used as the material for the metal plate 6. Tapped holes 6*a* are formed in the metal plate 6 with high accuracy at suitable positions corresponding to the side walls 3 and 4 of the pipe body 1. In the present embodiment, when the pipe body 1 is used as the frame of an image forming apparatus, the tapped holes 6*a* are used as engagement portions for attaching another pipe body to the pipe body 1 or attaching the pipe body 1 to a member in an image forming apparatus.

Further, as illustrated in FIG. 4, malleable portions 6*f* are formed in the metal plate 6 at the positions which will be in the side walls 3 and 4 of the pipe body 1. Specifically, a pair of the malleable portions 6*f* are positioned separately across each of the tapped holes 6*a* and they are provided along bending lines 6*c* and 6*d* extending parallel to the pair of edges 6*e* of the metal plate 6. The malleable portions 6*f* are formed while malleably deforming the metal plate 6 by a bead processing such that the malleable portions 6*f* extend in the vicinity of the tapped holes 6*a* in the direction perpendicular to the bending lines 6*c* and 6*d*. The end portions of each of the malleable portions 6*f* in its longitudinal direction are located near the bending lines 6*c* and 6*d*. The length of the malleable portion 6*f* extending in the direction perpendicular to the bending lines 6*c* and 6*d* is greater than the diameter of the tapped hole 6*a*. Further, the malleable portions 6*f* protrude from the surface of the metal plate 6 such that the malleable portions 6*f* project outward from the pipe body 1.

Figure 5A:
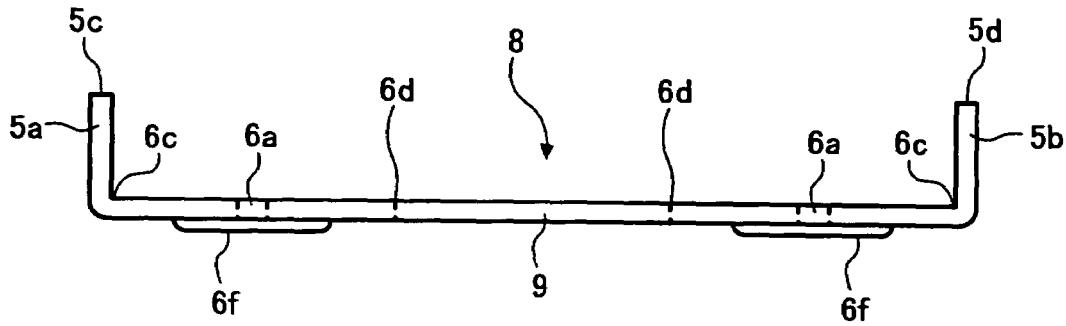
FIG. 5A is a side view of a primary intermediate product according to the embodiment.
Figure 5B:
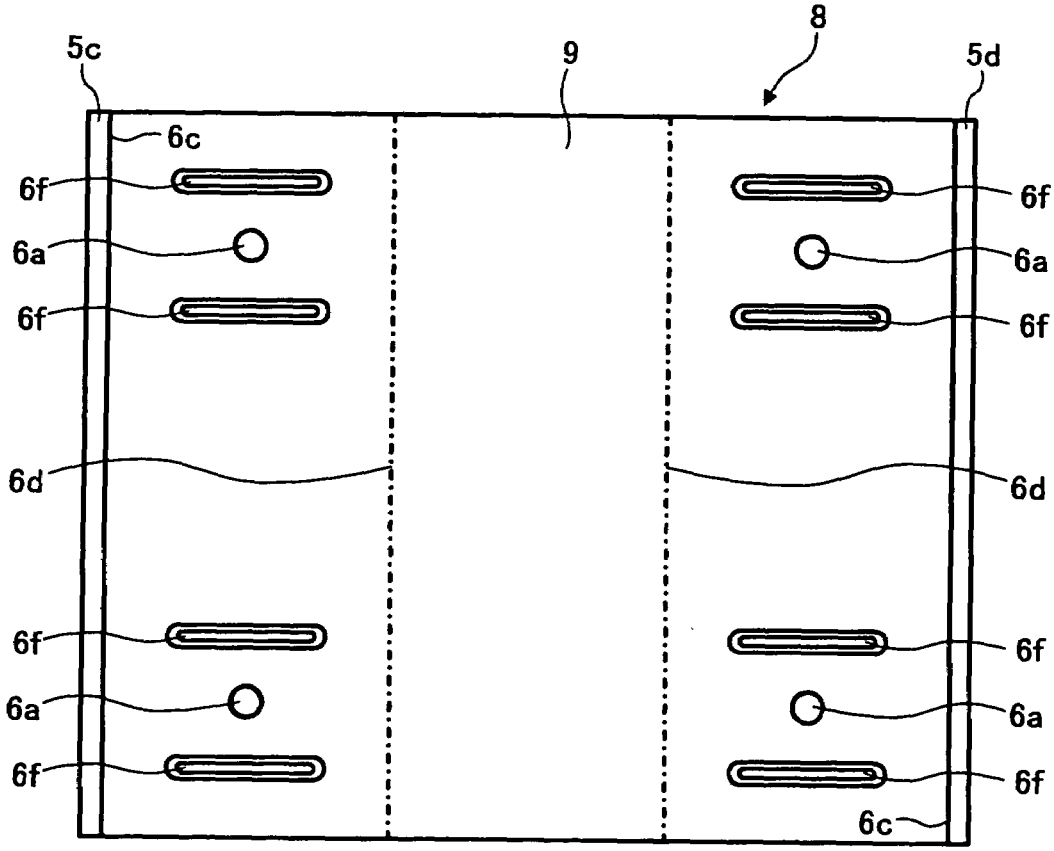
FIG. 5B is a plane view of the primary intermediate product of FIG. 5A.

In the first processing step, a pair of edge portions 6*b* of the metal plate 6 are bent at the right angle (90 degrees) along the bending lines 6*c* and stood up in the direction opposite to the direction in which the malleable portions 6*f* protrude from the surface of the metal plate 6. By this bending, the pair of edge portions 6*b* construct the walls 5*a* and 5*b* of the upper wall 5. As a result, a primary intermediate product 8 having a concave cross section is formed as illustrated in FIGS. 5A and 5B. In FIGS. 5A and 5B, a reference numeral 9 denotes the portion of the metal plate 6 to be bent along the bending lines 6*d* later. The width "L" of the metal plate 6 (illustrated in FIG. 4) and the positions of the bending lines 6*c* and 6*d* are designed by estimating the degree of extension of the metal plate 6 in pressing operation.

Figure 6A:
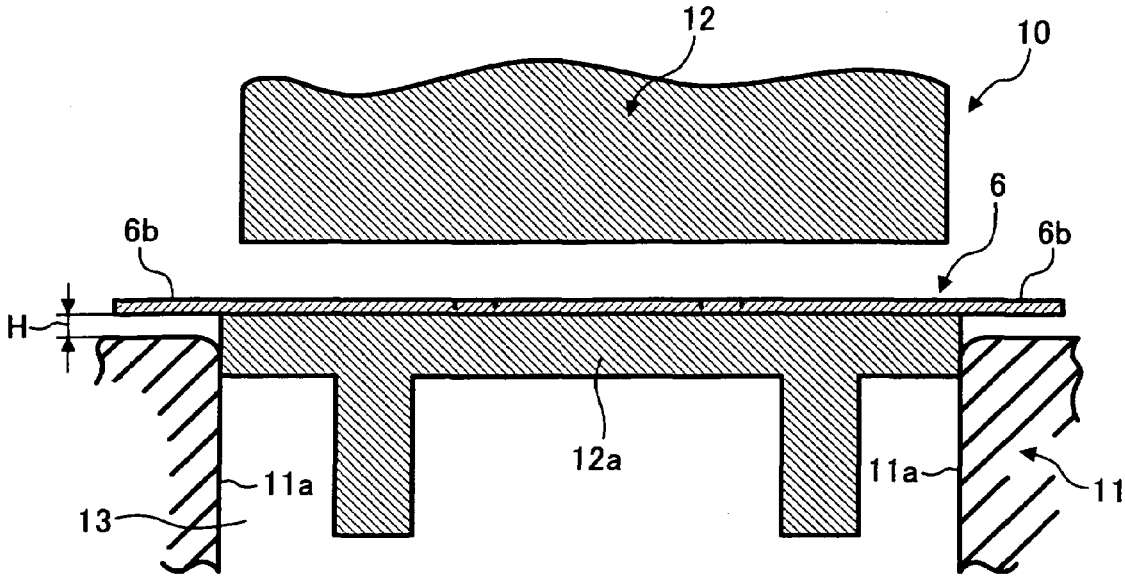
FIG. 6A is a schematic view showing a state of setting the metal plate on a movable plate.
Figure 6B:
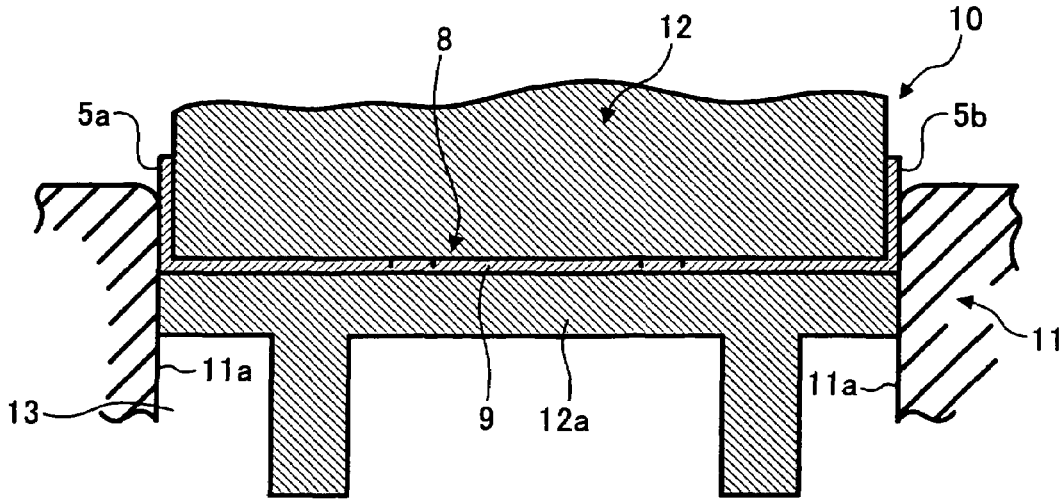
FIG. 6B is a schematic view showing a state that the primary intermediate product is manufactured by pressing the metal plate.

For pressing operation of the primary intermediate product 8, as illustrated in FIGS. 6A and 6B, for example, a presser 10 is used. The presser 10 includes a fixed plate 11, a press punching member 12, and a movable plate 12*a*. A concave portion 13 is provided to the fixed plate 11. The concave portions 13 is surrounded by a peripheral wall 11*a* of the fixed plate 11 in a shape corresponding to the outer shape of the primary intermediate product 8 (i.e., the outer shape of the walls 5*a* and 5*b* of the upper wall 5). Further, the press punching member 12 has a shape corresponding to the inner shape of the primary intermediate product 8, and moves up and down by a hydraulic cylinder device (not shown) relative to the concave portions 13. With the upward and downward movements of the press punching member 12, the movable plate 12*a* slides along the peripheral walls 11*a* of the fixed plate 11. The movable plate 12*a* is connected to another hydraulic cylinder device (not shown).

The primary intermediate product 8 is formed as follows. First, as illustrated in FIG. 6A, the metal plate 6 is set on the movable plate 12*a* located at the position higher than the fixed plate 11 by a distance "H". Then, as illustrated in FIG. 6B, the press punching member 12 is moved downward, thereby sandwiching the metal plate 6 between the press punching member 12 and the movable plate 12*a* under the pressure. When setting the metal plate 6 on the movable plate 12*a*, the metal plate 6 is set such that the malleable portions 6*f* direct downward (i.e., the malleable portions 6*f* protrude downward). The movable plate 12*a* is designed so as not to press the protrusions of the plastic deformation portions 6*f*.

Figure 7A:
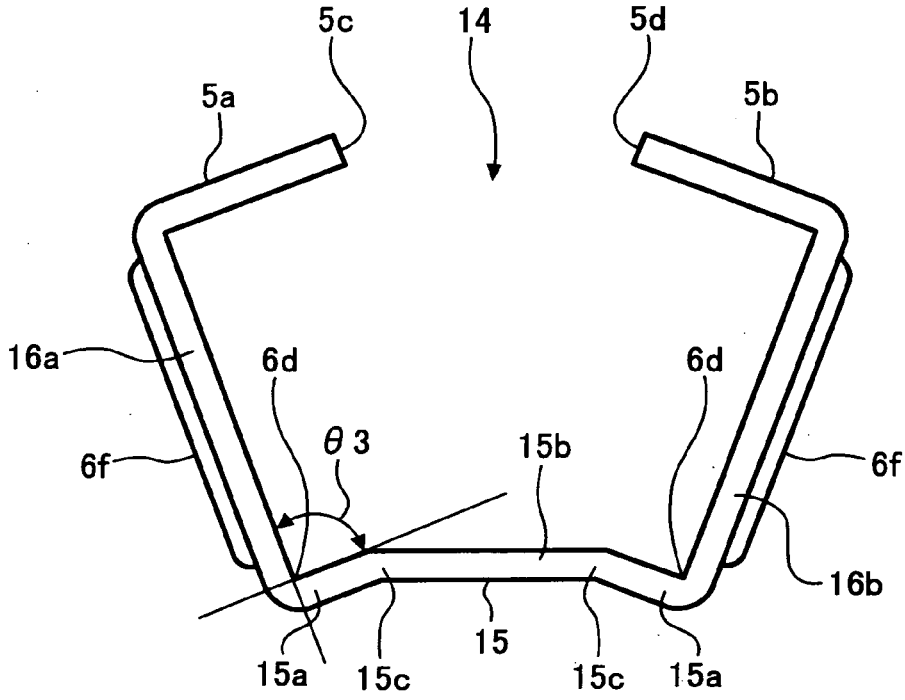
FIG. 7A is a side view of an entire secondary intermediate product according to the embodiment.

Subsequently, in the second processing step, the portion 9 of the primary intermediate product 8 illustrated in FIGS. 5A and 5B, is bent along the bending lines 6*d*. Further, each of the portions of the primary intermediate product 8 between the bending lines 6*c* and 6*d* is bent upward. By this bending, a wall 15 constructing the bottom wall 2 of the pipe body 1, an adjoining wall 16*a* constructing the side wall 3 of the pipe body 1, and an adjoining wall 16*b* constructing the side wall 4 of the pipe body 1 are formed. As a result, as illustrated in FIGS. 7A and 7B and FIG. 8, a secondary intermediate product 14 is formed.

Figure 7B:
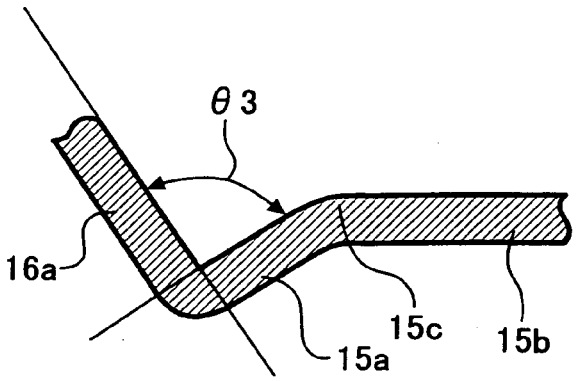
FIG. 7B is a partial enlarged view of the secondary intermediate product of FIG. 7A.
Figure 8:
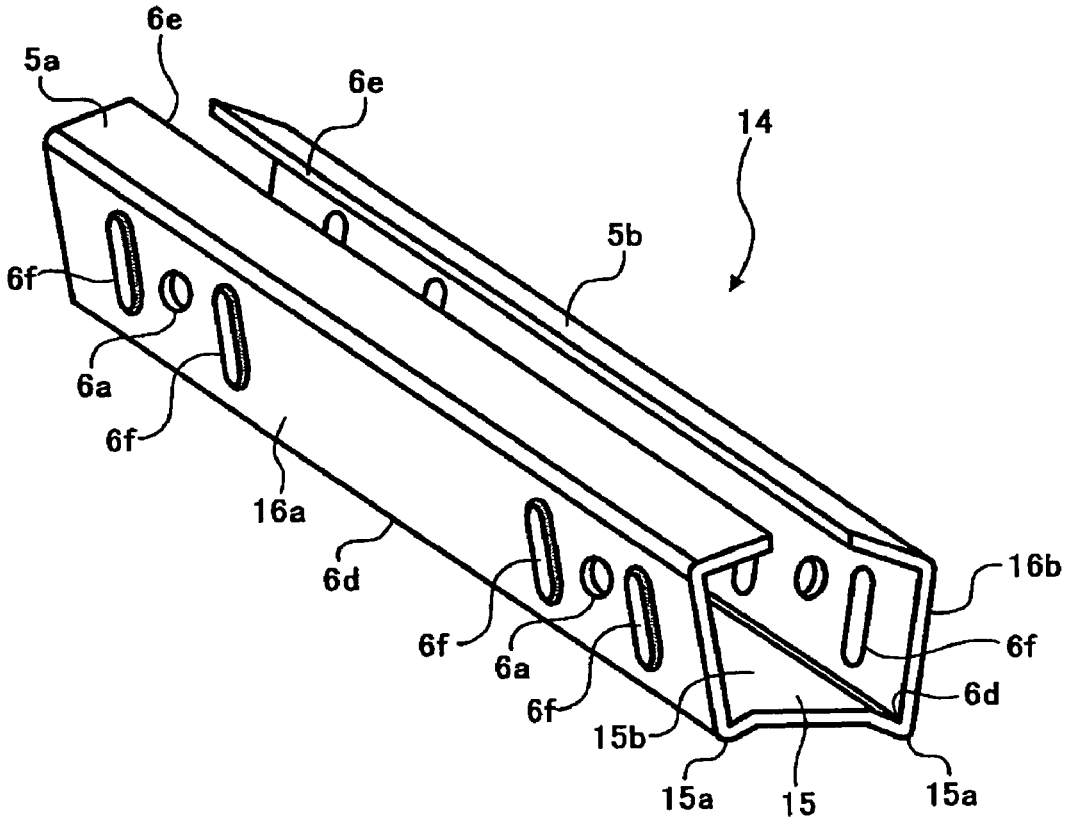
FIG. 8 is a perspective view of the secondary intermediate product of FIG. 7A.

As illustrated in the enlarged view of FIG. 7B, the wall 15 of the secondary intermediate product 14 includes flat plates 15*a* and 15*b* and a curved portion 15*c*. The curved portion 15*c* is placed between the two flat plates 15*a* and 15*b*. The flat plate 15*a* adjoins the adjoining wall 16*a* or 16*b*. An angle θ3 formed between the flat plate 15*a* and the adjoining wall 16*a* or 16*b* is an obtuse angle that is greater than an angle θ2 (i.e., 90 degrees as illustrated in FIG. 3) formed between the bottom wall 2 and the side wall 3 or 4. The edges 6*e* of the metal plate 6 constructing the end surfaces 5*c* and 5*d* of the upper wall 5 of the pipe product 1 are away from each other due to the above-described shape of the wall 15.

Figure 9A:
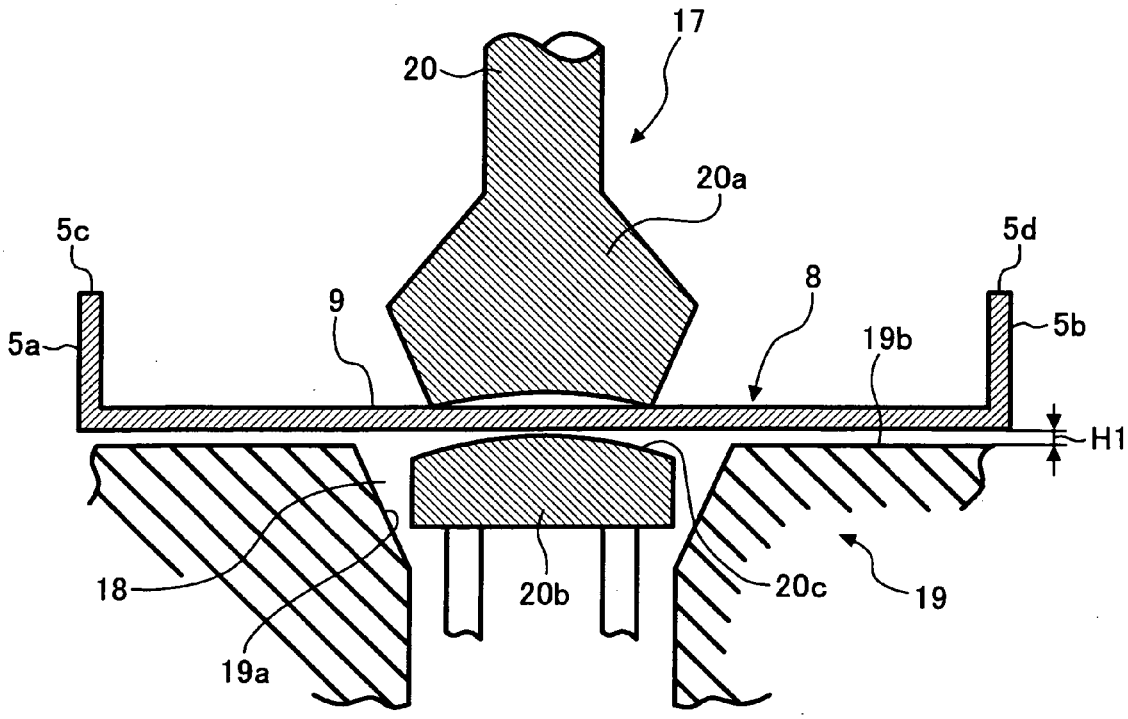
FIG. 9A is a schematic view showing a state of setting the primary intermediate product on a movable plate.
Figure 9B:
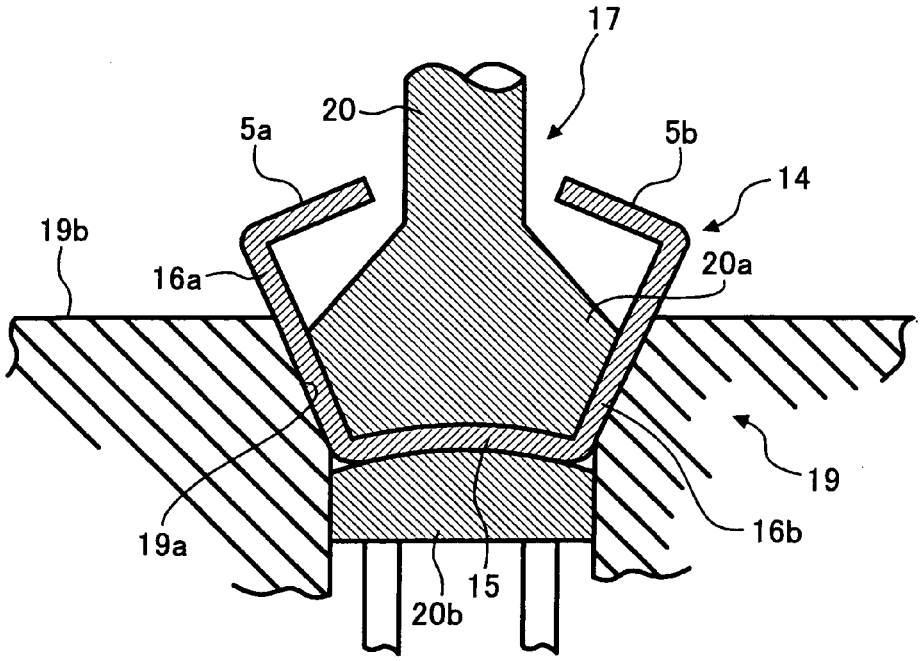
FIG. 9B is a schematic view showing a state that the secondary intermediate product is manufactured by pressing the primary intermediate product.

As illustrated in FIGS. 9A and 9B, for example, a presser 17 is used for pressing operation for the secondary intermediate product 14. This presser 17 includes a fixed plate 19, a press punching member 20, and a movable plate 20*b*. A concave portion 18 is surrounded by a peripheral wall 19*a* of the fixed plate 19 having a shape corresponding to the outer shape of the secondary intermediate product 14 (i.e., the outer shape of the adjoining walls 16*a* and 16*b* of the secondary intermediate product 14). The peripheral wall 19*a* and a top surface 19*b* of the fixing plate 19 have recess portions (not shown) into which the protruding portions of the plastic deformation portions 6*f* are fit so as not to be pressed when the primary intermediate product 8 is subjected to the pressing process.

The press punching member 20 is moved up and down by a hydraulic cylinder device (not shown) relative to the concave portion 18. The press punching member 20 includes a punching portion 20*a* at the lower part thereof. The punching portion 20*a* has a shape corresponding to the inner shape of the wall 15 and the lower inner shape of the adjoining walls 16*a* and 16*b* of the secondary intermediate product 14. With the upward and downward movements of the press punching member 20, the movable plate 20*b* slides along the peripheral wall 19*a* of the fixed plate 19. The movable plate 20*b* is connected to another hydraulic cylinder device (not shown). A top surface 20*c* of the movable plate 20*b* has a shape corresponding to the outer shape of the wall 15 of the secondary intermediate product 14.

When the press punching member 20 and the movable plate 20*b* are located at an upper position, the primary intermediate product 8 is set on the top surface 20*c* of the movable plate 20*b* positioned higher than the fixed plate 19 by a distance H1 as illustrated in FIG. 9A. Subsequently, the press punching member 20 is moved downward, thereby forcing the primary intermediate product 8 into the concave portion 18 with pressure while sandwiching the portion 9 of the primary intermediate product 8 between the punching portion 20*a* of the press punching member 20 and the top surface 20*c* of the movable plate 20*b*. As a result, the secondary intermediate product 14 is formed as illustrated in FIG. 9B. After raising the press punching member 20, the secondary intermediate product 14 is taken out from the presser 17 by drawing out the secondary intermediate product 14 in its longitudinal direction (i.e., in the direction perpendicular to the sheet of FIGS. 9A and 9B).

Figure 10:
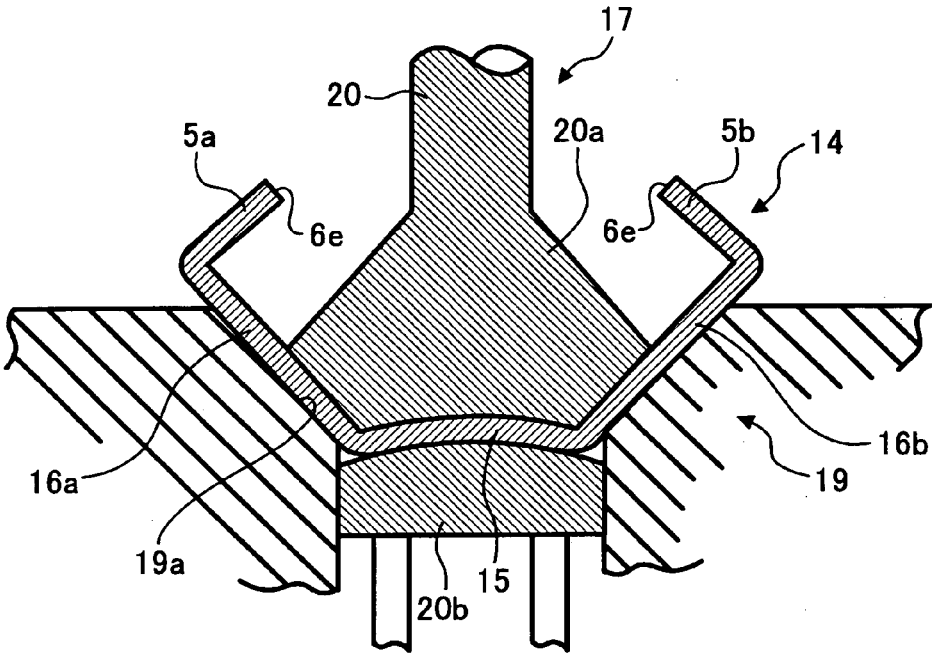
FIG. 10 is a view for explaining another example of a press forming device for forming a secondary intermediate product.
Figure 11:
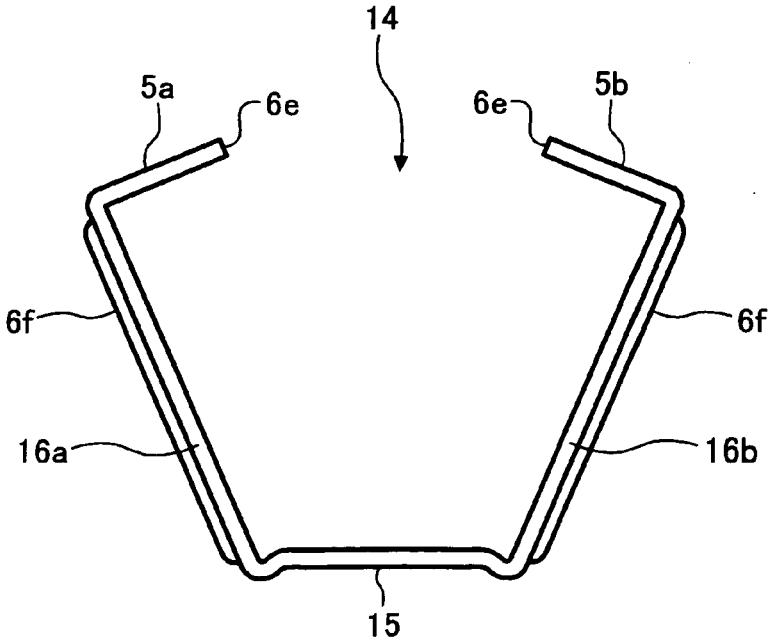
FIG. 11 is a side view of a secondary intermediate product according to another example.

However, if the wall 15 of the secondary intermediate product 14 is curved greater than the wall 15 as shown in FIG. 9B, and the adjoining walls 16*a* and 16*b* of the secondary intermediate product 14 are opened more outwardly as illustrated in FIG. 10, and also each of the adjoining walls 16*a* and 16*b* is substantially wider than the wall 15 as illustrated in FIG. 11, the secondary intermediate product 14 can be taken out from the presser 17 using a space between the edges 6*e* of the metal plate 6 only by raising the press punching member 20. Therefore, in the secondary intermediate product 14 illustrated in FIGS. 10 and 11, the process of drawing out the secondary intermediate product 14 in the longitudinal direction of the secondary intermediate product 14 can be omitted, thereby enhancing efficiency and saving a space necessary for the forming operation.

Figure 12:
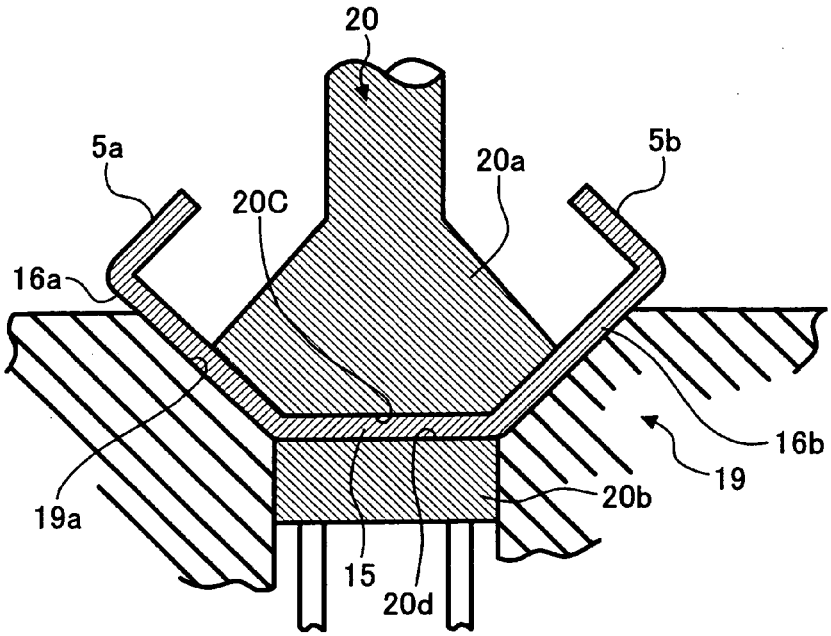
FIG. 12 is a view for explaining another example of a press forming device for forming a secondary intermediate product.
Figure 13:
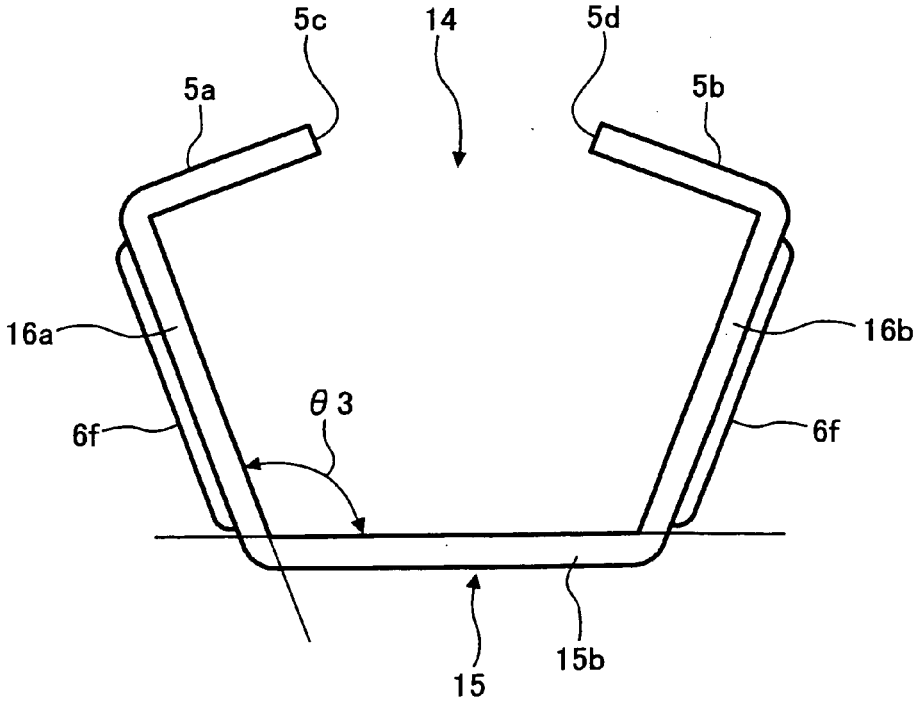
FIG. 13 is a side view of the secondary intermediate product formed by the press forming device of FIG. 12.

A secondary intermediate product having a flat wall 15 illustrated in FIG. 13 may be formed by use of a presser illustrated in FIG. 12. However, for the flatness of the bottom wall 2 of the completed pipe body 1 and the ease of taking out the secondary intermediate product 14 from the presser 17 only by raising the press punching member 20, it is preferable that the wall 15 of the secondary intermediate product 14 be curved as illustrated in FIGS. 7A, 7B and 8. As described above, the exemplary wall 15 illustrated in FIGS. 7A, 7B and 8 includes the flat plates 15*a* and 15*b* and the curved portion 15*c*, but curving condition of the wall 15 is not limited to this.

Figure 14:
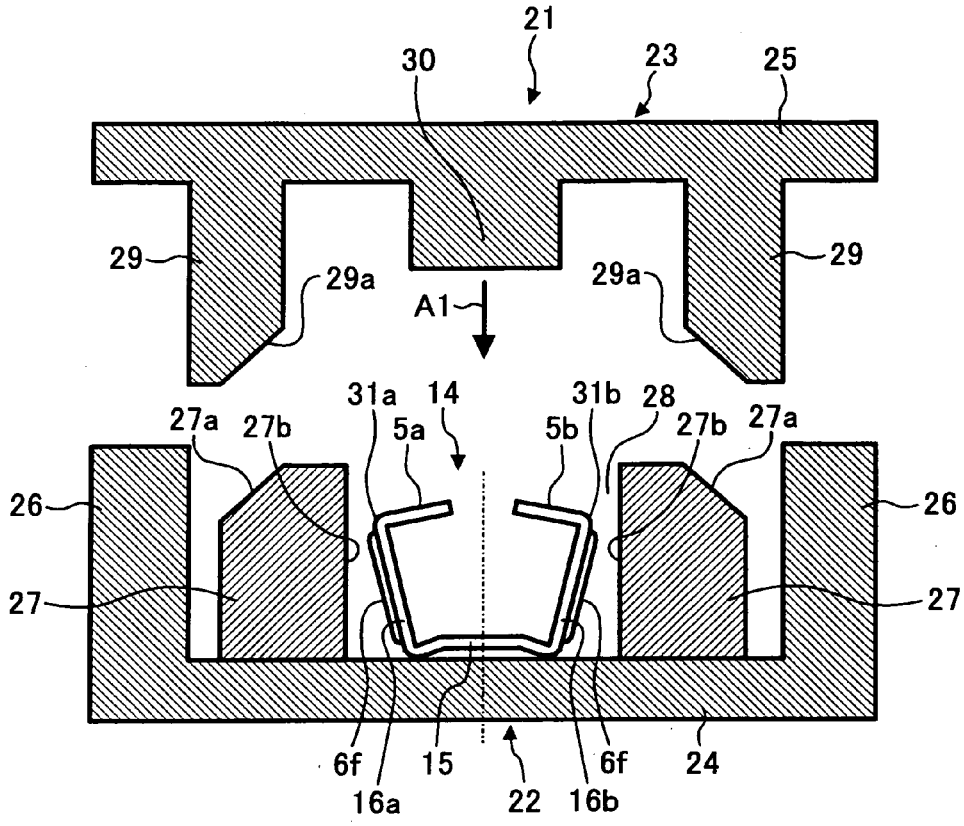
FIG. 14 is a schematic view showing a state that the secondary intermediate product of FIGS. 7A and 8 is set in a press forming device.

Next, as illustrated in FIG. 14, the secondary intermediate product 14 is set in a press forming device 21 to form the pipe body 1 as a finished product. The press forming device 21 includes a lower mold (fixed mold) 22 and an upper mold (movable mold) 23. The lower mold 22 includes a fixed plate 24, and the upper mold 23 includes a movable plate 25 driven to move up and down by a hydraulic cylinder device (not shown). A pair of stopper members 26 and a pair of press punching members 27 are provided to the fixed plate 24 as illustrated in FIG. 14.

The pair of press punching members 27 are slidably mounted on a sliding rail (not shown) that extends in the horizontal direction in FIG. 14, and are moved on the sliding rail while being away from or approaching each other by a cam mechanism (not shown). Further, when the upper mold 23 and the lower mold 22 are away from each other, the press punching members 27 are biased by a spring member (not shown) in the direction away from each other.

Punching surfaces 27*b* are formed on the surfaces of the press punching members 27 facing each other to press the adjoining walls 16*a* and 16*b* of the secondary intermediate product 14, respectively. The punching surfaces 27*b* do not extend across the secondary intermediate product 14 along the bending lines 6*c* and 6*d* of the metal plate 6. Thus, when the secondary intermediate product 14 is subjected to the pressing process, the malleable portions 6*f* are not pressed by the punching surfaces 27*b*.

A pair of driving members 29 for driving the press punching members 27 and a press punching member 30 for pressing the walls 5*a* and 5*b* are provided to the movable plate 25. Taper portions 29*a* are formed at lower end portions of the driving members 29, respectively. Further, taper portions 27*a* are formed at upper end portions of the press punching members 27, respectively, to engage with the taper portions 29*a*.

Figure 15:
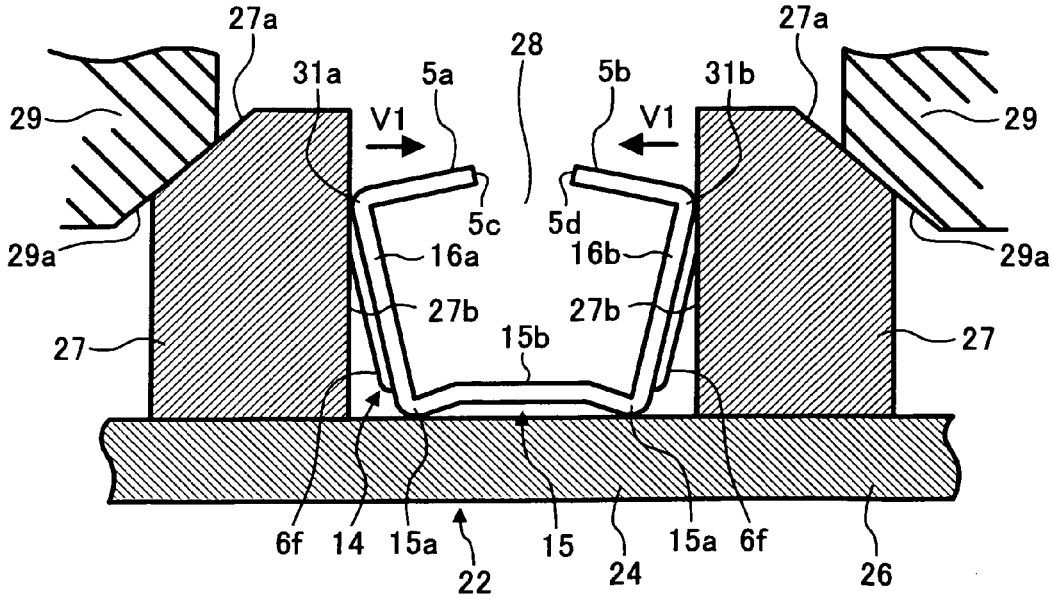
FIG. 15 is a schematic view showing a state that press punching members abut curved portions of the secondary intermediate product set in the press forming device of FIG. 14.

In a third processing step, as illustrated in FIG. 14, the secondary intermediate product 14 is set at a center position in a space 28 formed between the pair of press punching members 27 such that the wall 15 of the secondary intermediate product 14 is directed downward. When the upper mold 23 moves down in the direction of Arrow (A1) in FIG. 14, the taper portions 29*a* of the driving members 29 engage with the taper portions 27*a* of the press punching members 27, and thereby the press punching members 27 are moved in the direction approaching toward each other at the substantially same speed of V1 against the bias force of the above-described spring member as illustrated in FIG. 15. Then, the punching surfaces 27*b* of the press punching members 27 abut a curved portion 31*a* of the adjoining wall 16*a* and a curved portion 31*b* of the adjoining wall 16*b*, respectively, substantially simultaneously. Subsequently, the adjoining walls 16*a* and 16*b* are pressed by the external force of the press punching members 27 in the direction approaching toward each other.

Figure 16:
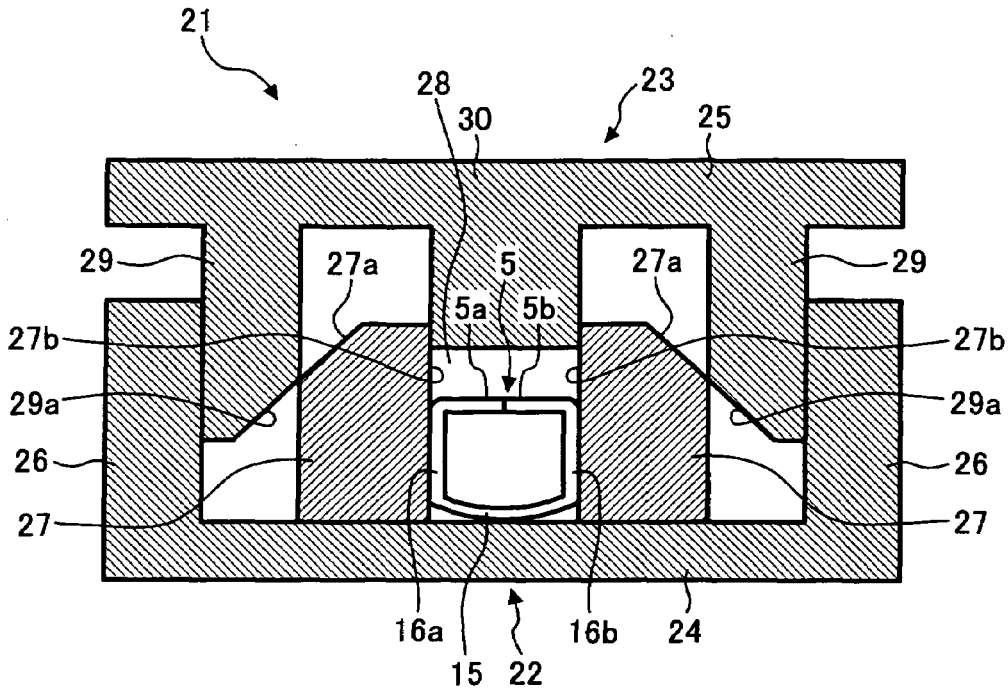
FIG. 16 is a schematic view showing a state that the press punching members stop moving in the press forming device of FIG. 14.

When the press punching members 27 are moved in the direction approaching toward each other, the curved portions 31*a* and 31*b* slide along the punching surfaces 27*b* upward, and thereby the adjoining walls 16*a* and 16*b* stand up, so that the side walls 3 and 4 of the pipe body 1 are formed. Further, the end surfaces 5*c* and 5*d* of the walls 5*a* and 5*b* approach toward each other while eliminating the curved portion of the wall 15, and are brought into intimate contact with each other. As a result, the upper wall 5 of the pipe body 1 is formed as illustrated in FIG. 16. In this condition, an angle formed between the wall 15 and the adjoining wall 16*a* or 16*b* decreases than before, but does not become 90 degrees. Further, the wall 15 expands downward (i.e., outward) and is curved in the opposite direction than before.

Figure 17:
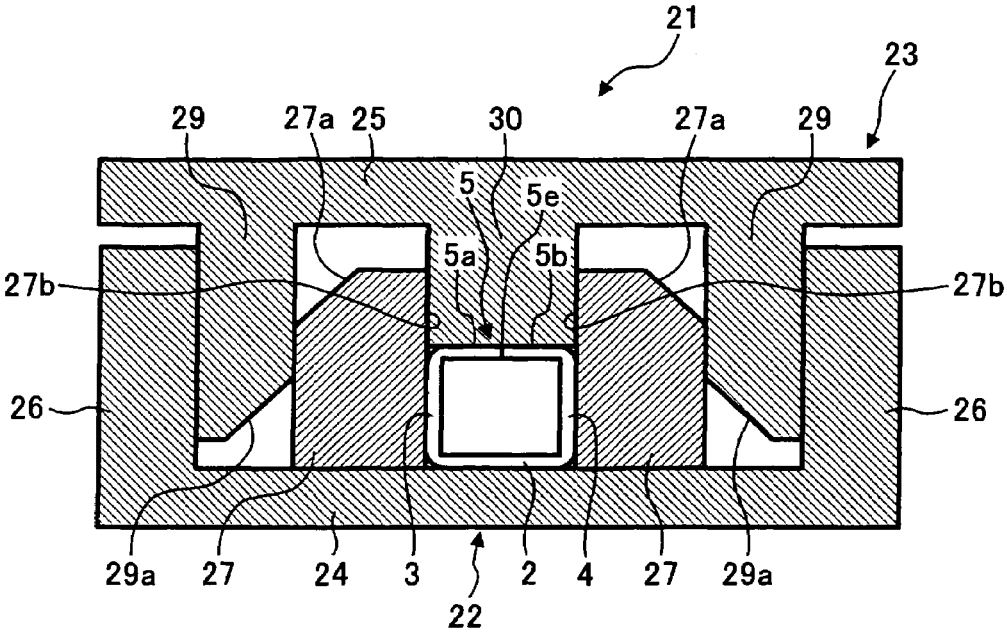
FIG. 17 is a schematic view showing a state that another press punching member presses an upper wall of the secondary intermediate product in the press forming device of FIG. 14.

In the fourth processing step, when the upper mold 23 further descends, the state of the taper portions 27*a* of the press punching members 27 and the taper portions 29*a* of the driving members 29 engaging each other is released. As a result, the press punching members 27 are stopped. When the upper mold 23 further descends in this condition, the press punching member 30 contacts and presses the upper wall 5. As a result, the wall 15 is flattened, thereby forming the bottom wall 2 of the pipe body 1 as illustrated in FIG. 17.

Further, when the upper mold 23 and the lower mold 22 are separated from each other while raising the upper mold 23, the pair of press punching members 27 move in the direction away from each other again. Finally, the pipe body 1 is obtained as a finished product.

Figure 18:
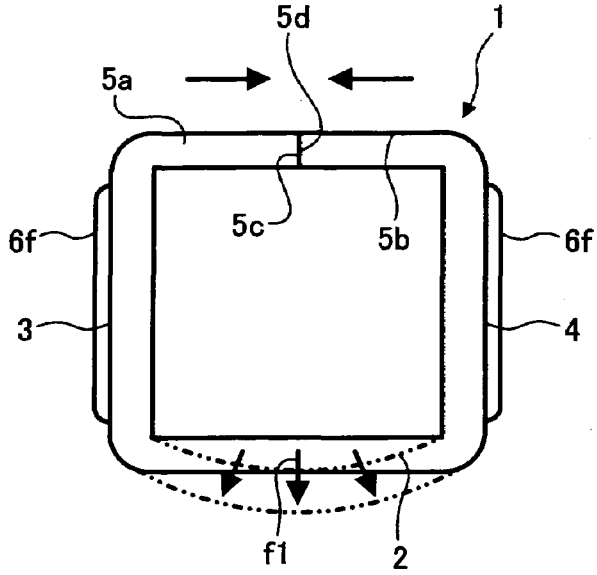
FIG. 18 is a schematic view for explaining a spring back force produced in the pipe body of FIGS. 2 and 3.

Generally, when a work piece is deformed by a press processing, there is typically a spring back phenomenon in which a work piece deformed by the application of an external force tends to return to its original shape by the elasticity of the work piece. Therefore, as illustrated in FIG. 18, the surface of the bottom wall 2 of the pipe body 1 tends to return to the curved surface by a spring back force (f1) as illustrated by dotted lines in FIG. 18. The spring back force (f1) remaining in the bottom wall 2 maintains the end surfaces 5*c* and 5*d* of the upper wall 5 in close contacted condition.

In the above-described manufacturing method of the pipe body 1 according to one embodiment, the malleable portions 6*f* extending in the direction perpendicular to the bending lines 6*c* and 6*d* are formed in the adjoining walls 16*a* and 16*b* of the secondary intermediate product 14. Therefore, even when an external force is applied to the curved portion of the wall 15, the side walls 3 and 4 of the pipe body 1 are prevented from deforming as the malleable portions 6*f* absorb undesirable external force.

As described above, in this embodiment, the tapped holes 6*a* are formed in the adjoining walls 16*a* and 16*b* of the secondary intermediate product 14, and the pair of malleable portions 6*f* are positioned separately across each of the tapped holes 6*a* along the bending lines 6*c* and 6*d* in the adjoining walls 16*a* and 16*b*. Further, the malleable portion 6*f* extending in the direction perpendicular to the bending lines 6*c* and 6*d* is longer than the diameter of the tapped hole 6*a*. With such malleable portions 6*f*, external forces applied to the adjoining walls 16*a* and 16*b* during the press process are concentrated toward the malleable portions 6*f*, thereby avoiding the deformation of the tapped holes 6*a*. Therefore, even when the tapped holes 6*a* are required to be formed with high accuracy, the inspection of all completed products need not be performed. As a result, a manufacturing cost of the pipe body is not increased due to the inspection of all completed products.

Moreover, because the malleable portions 6*f* extend in the direction perpendicular to the bending lines 6*c* and 6*d* in the adjoining walls 16*a* and 16*b*, when external forces are applied to the upper wall 5 and the bottom wall 2, the direction of the external forces coincides with the extending direction of the malleable portions 6*f*. Therefore, the strength of the adjoining walls 16*a* and 16*b* against the pressure from the punching member 30 is effectively increased. Further, because the malleable portions 6*f* are formed adjacent to the tapped holes 6*a*, the stress generated in the vicinity of the tapped holes 6*a* is directed toward the malleable portions 6*f*, thereby avoiding the deformation of the tapped holes 6*a*. Further, because the malleable portions 6*f* are formed by a bead processing, the malleable portions 6*f* are easily formed in the adjoining walls 16*a* and 16*b* at a low cost.

Next, another embodiment of the present invention will be described. In this embodiment, in the third processing step, the pipe body 1 is formed by using a press forming device 21*a* illustrated in FIG. 19 instead of the press forming device 21 illustrated in FIG. 14. The construction of the press forming device 21*a* is similar to that of the press forming device 21 except that frictional contact members 27*c* having high coefficient of friction are provided on the punching surfaces 27*b* of the press punching members 27. Therefore, the elements in the press forming device 21*a* having the same functions as those in the press forming device 21 are designated by the same reference numerals and their descriptions are omitted here.

Figure 19:
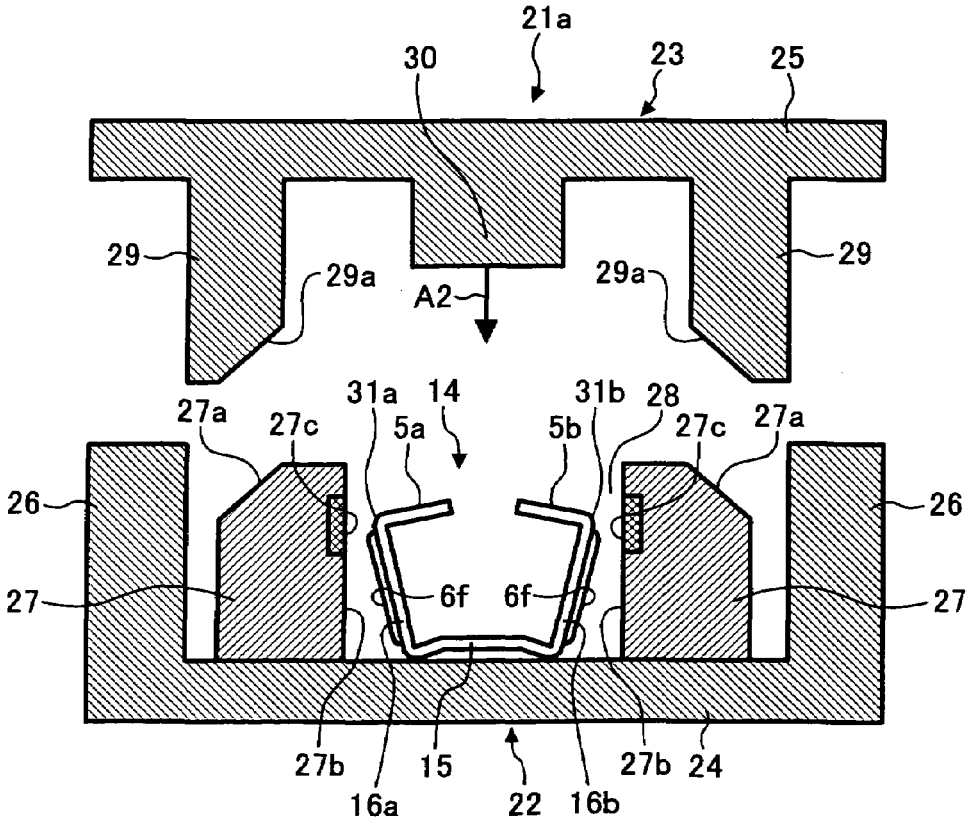
FIG. 19 is a schematic view showing a state that a secondary intermediate product is set in a press forming device according to another embodiment.
Figure 20:
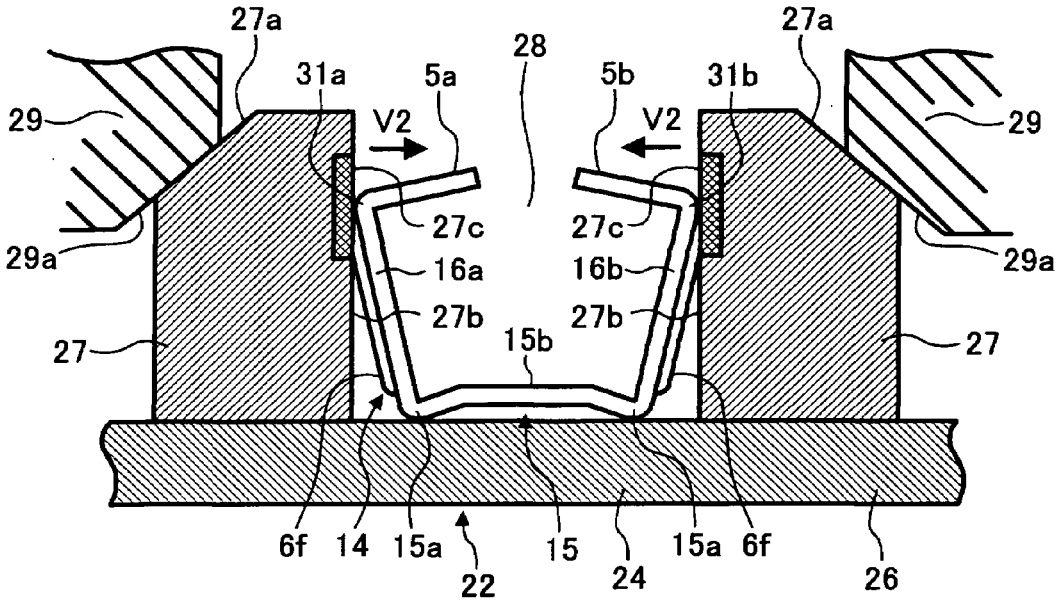
FIG. 20 is a schematic view showing a state that press punching members abut curved portions of the secondary intermediate product set in the press forming device of FIG. 19.

Referring to FIG. 19, in the third processing step, the secondary intermediate product 14 which has been subjected to the first and second processing steps is set at a center position in the space 28 formed between the pair of press punching members 27 such that the wall 15 of the secondary intermediate product 14 is directed downward. When the upper mold 23 moves down in the direction of Arrow (A2) in FIG. 19, the taper portions 29*a* of the driving members 29 engage with the taper portions 27*a* of the press punching members 27, and thereby the press punching members 27 are moved in the direction approaching toward each other at the substantially same speed of V2 against the bias force of the above-described spring member as illustrated in FIG. 20. Then, the punching surfaces 27*b* of the press punching members 27 abut against the curved portion 31*a* of the adjoining wall 16*a* and the curved portion 31*b* of the adjoining wall 16*b*, respectively, substantially simultaneously. Subsequently, the adjoining walls 16*a* and 16*b* are pressed by the external force of the press punching members 27 in the direction approaching toward each other.

When the press punching members 27 are moved in the direction approaching toward each other, the end surfaces 5*c* and 5*d* of the walls 5*a* and 5*b* approach toward each other while the curved portion of the wall 15 is being straightened, and are brought into intimate contact with each other. As a result, the upper wall S of the pipe body 1 is formed. In this condition, although the wall 15 tends to expand downward (i.e., outward), when the wall 15 contacts the fixed plate 24, the wall 15 cannot further expand downward because the maximum static frictional force between the curved portions 31*a*/31*b* and the frictional contact members 27*c* of the press punching members 27 is relatively large, so that the wall 15 is kept flat.

Figure 21:
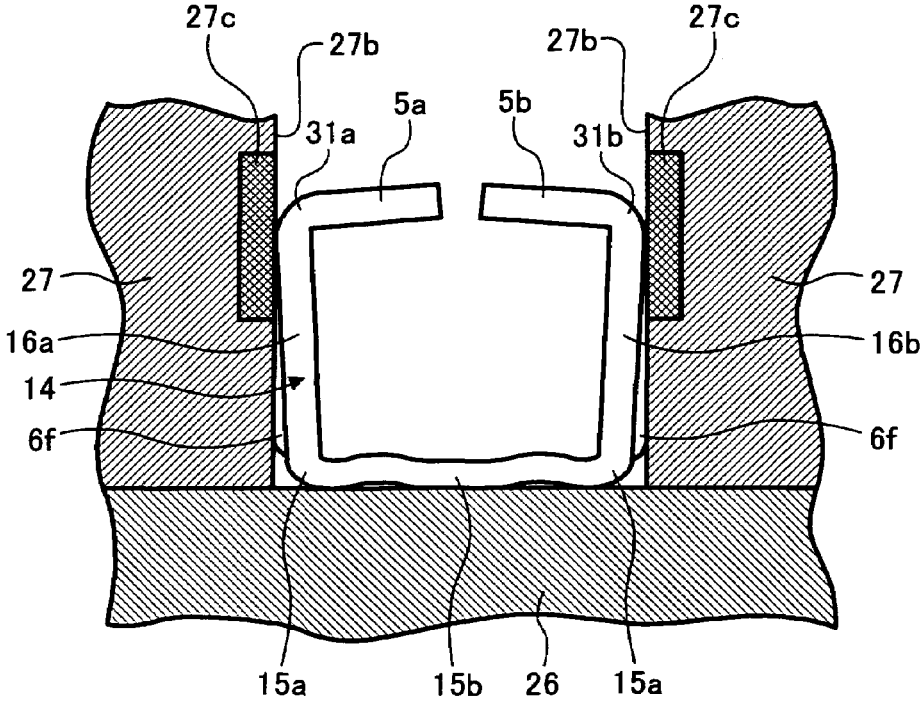
FIG. 21 is a schematic view showing a state that a bottom wall of the secondary intermediate product is inhibited from expanding outward in the press forming device of FIG. 19.
Figure 22:
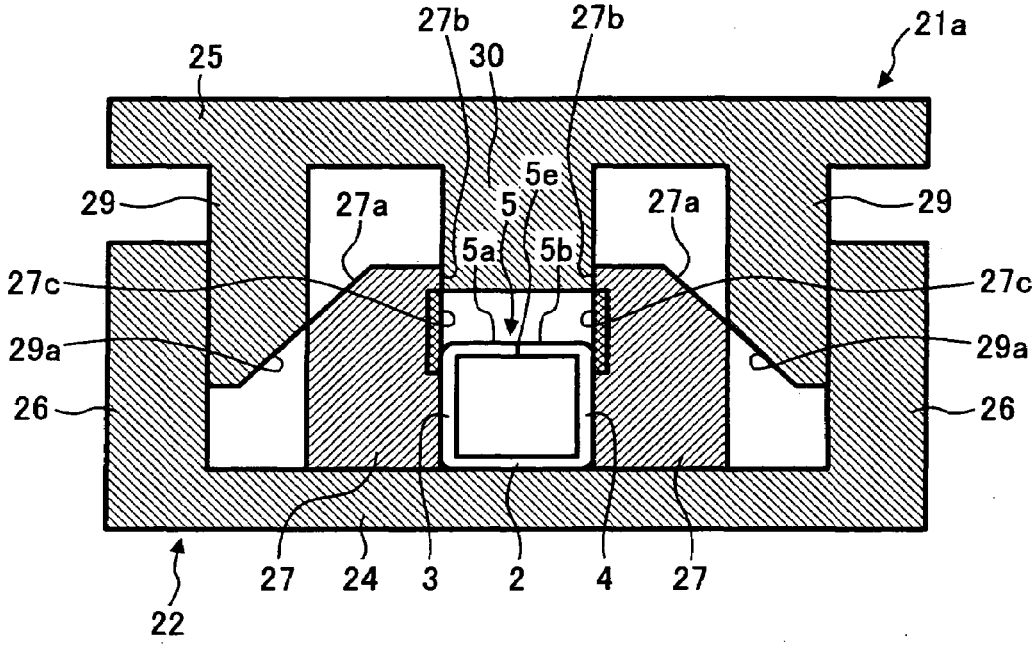
FIG. 22 is a schematic view showing a state that the press punching members stop moving in the press forming device of FIG. 19.

Further, referring to FIG. 21, the curved portions 31*a* and 31*b* slightly slide upward along the frictional contact members 27*c* of the press punching members 27 within such a range that the wall 15 does not float up from the fixed plate 24, and thereby the adjoining walls 16*a* and 16*b* stand up, and the side walls 3 and 4 of the pipe body 1 are formed. Further, the wall 15 forms the bottom wall 2 of the pipe body 1 as illustrated in FIG. 22.

Figure 23:
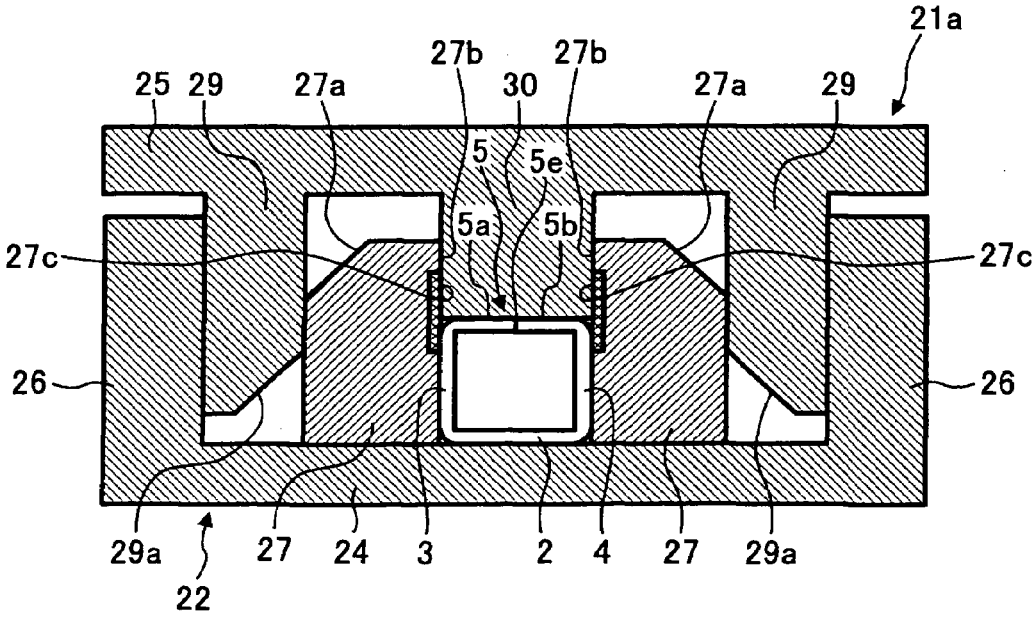
FIG. 23 is a schematic view showing a state that another press punching member presses an upper wall of the secondary intermediate product in the press forming device of FIG. 19.

In the fourth processing step, when the upper mold 23 further descends, the state of the taper portions 27*a* of the press punching members 27 and the taper portions 29*a* of the driving members 29 which engage each other is released. As a result, the press punching members 27 are stopped. When the upper mold 23 further descends in this condition, the press punching member 30 contacts and presses the upper wall 5. As a result, the bottom wall 2 and the upper wall 5 become more planar as illustrated in FIG. 23.

Further, when the upper mold 23 and the lower mold 22 are separated from each other while raising the upper mold 23, the pair of press punching members 27 move in the direction away from each other again. Finally, the pipe body 1 is obtained as a completed product. Similarly as in the pipe body 1 formed by the press forming device 21, the spring back force remaining in the bottom wall 2 maintains the end surfaces 5*c* and 5*d* in close contacted condition.

In the above-described manufacturing method of the pipe body 1 according to another embodiment, the malleable portions 6*f* that extend in the direction perpendicular to the bending lines 6*c* and 6*d* are formed in the adjoining walls 16*a* and 16*b* of the secondary intermediate product 14. Therefore, even when an external force is applied to the upper wall 5 of the pipe body 1, the deformation of the side walls 3 and 4 of the pipe body 1 and the deformation of the tapped holes 6*a* in the side walls 3 and 4 are prevented as the malleable portions 6*f* absorb the external force.

Figure 24:
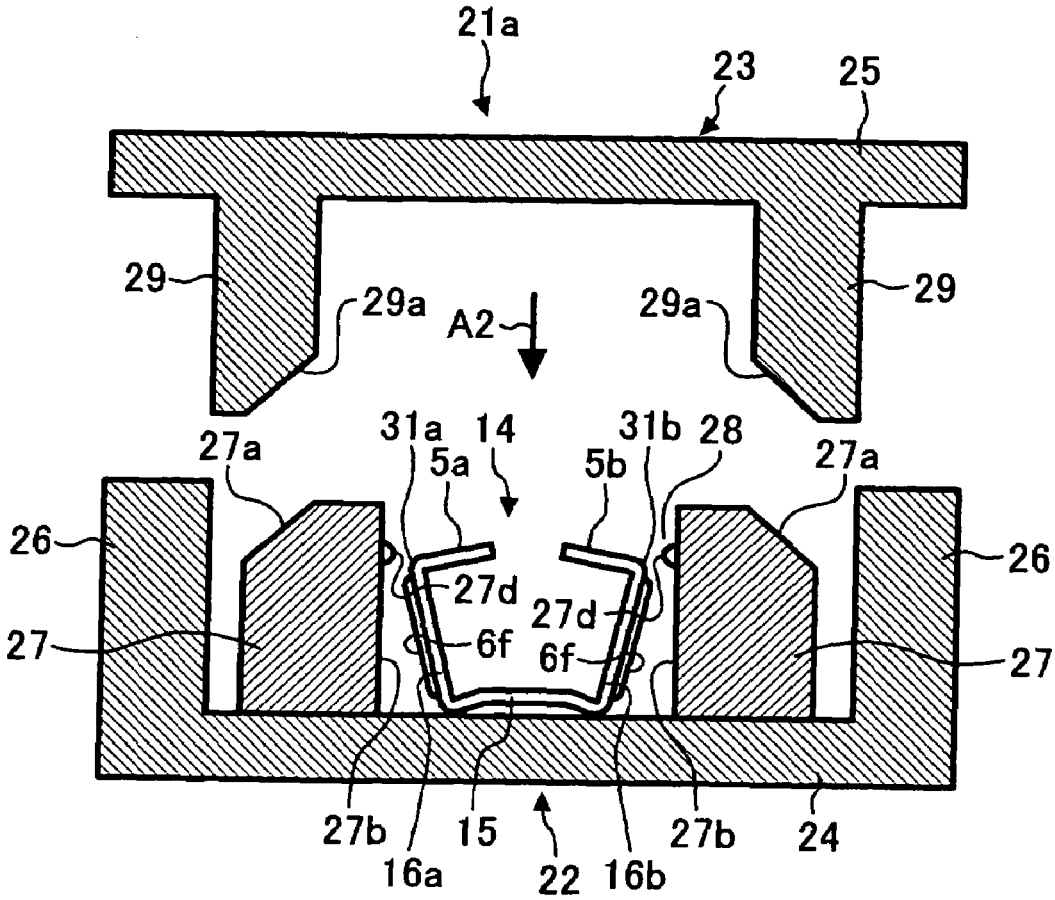
FIG. 24 is a schematic view of a press forming device according to an alternative example.

To prevent the secondary intermediate product 14 from floating up from the fixed plate 24 and the wall 15 from expanding downward (i.e., outward), protrusions 27*d* may be provided at the pressure punch members 27 instead of the friction contact members 27*c* as illustrated in FIG. 24.

Figure 25A:
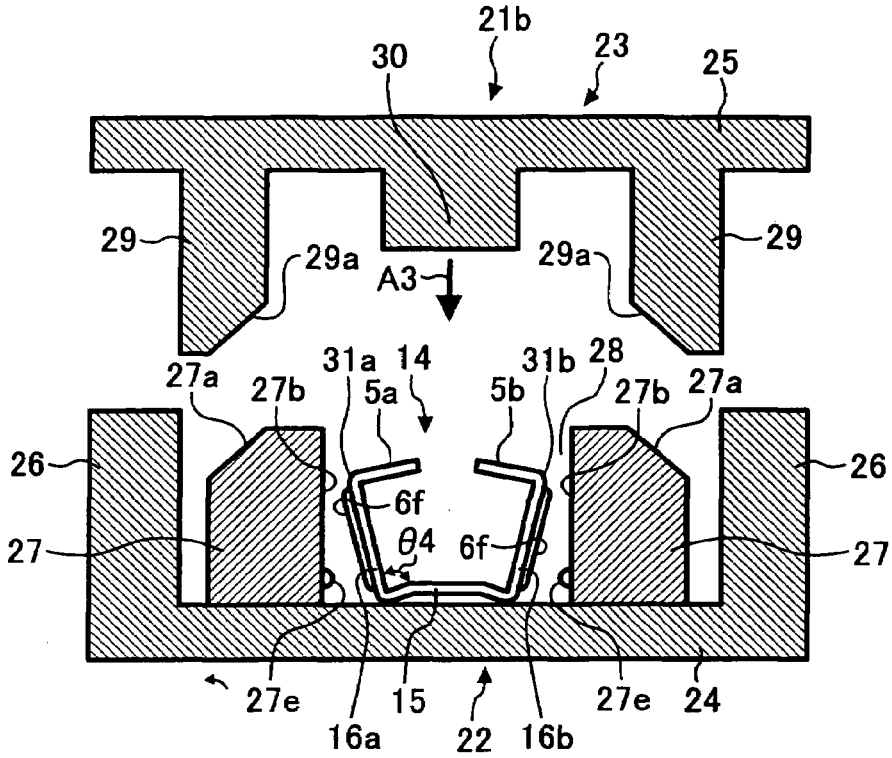
FIG. 25 is a schematic view showing a state that a secondary intermediate product is set in a press forming device according to another embodiment.
Figure 25B:
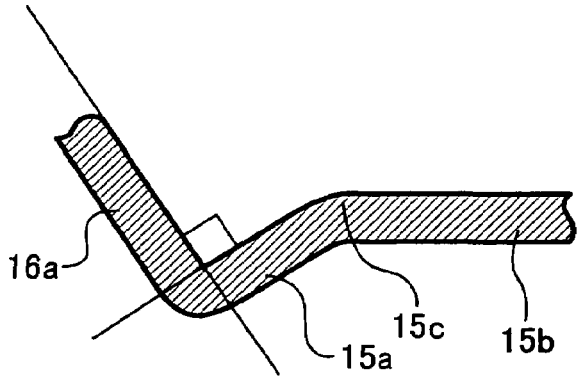
Figure 26:
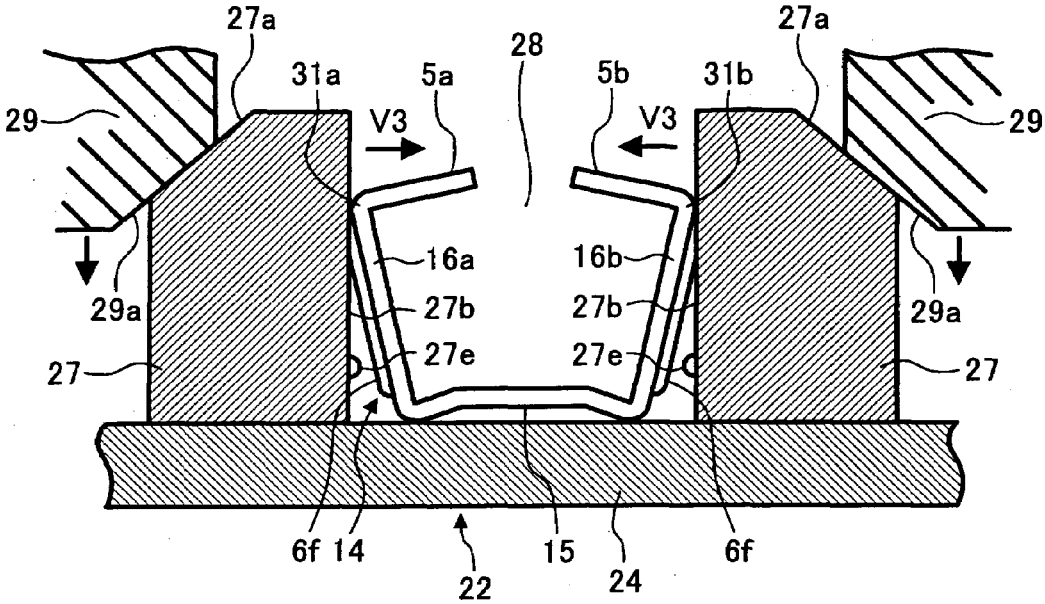
FIG. 26 is a schematic view showing a state that press punching members abut curved portions of the secondary intermediate product set in the press forming device of FIG. 25.

Next, another embodiment of the present invention will be described. In this embodiment, a secondary intermediate product 14*a* is formed in the first and second processing steps such that an angle (θ4) between the flat part 15*a* of the wall 15 and the adjoining walls 16*a* or 16*b* is substantially 90 degrees as illustrated in FIGS. 25A and 25B. Further, in the third processing step, a pipe body 1*a* is formed by using a press forming device 21*b* illustrated in FIG. 25 instead of the press forming device 21. The construction of the press forming device 21*b* is similar to that of the press forming device 21 except that protrusions 27*e* are provided at the punching surfaces 27*b* of the press punching members 27. Therefore, the elements in the press forming device 21*b* having the same functions as those in the press forming device 21 are designated by the same reference numerals and their descriptions are omitted here.

Referring to FIG. 25, in the third processing step, the secondary intermediate product 14*a* which has been subjected to the first and second processing steps is set at a center position in the space 28 formed between the pair of press punching members 27 such that the wall 15 of the secondary intermediate product 14*a* is directed downward. When the upper mold 23 moves down in the direction of Arrow (A3) in FIG. 25, the taper portions 29*a* of the driving members 29 engage with the taper portions 27*a* of the press punching members 27, and thereby the press punching members 27 are moved in the direction approaching toward each other at the substantially same speed of V3 against the bias force of the above-described spring member as illustrated in FIG. 25. Then, the punching surfaces 27*b* of the press punching members 27 abut against the curved portion 31*a* of the adjoining wall 16*a* and the curved portion 31*b* of the adjoining wall 16*b*, respectively, substantially simultaneously. Subsequently, the adjoining walls 16*a* and 16*b* are pressed by the external force of the press punching members 27 in the direction approaching toward each other.

Figure 27:
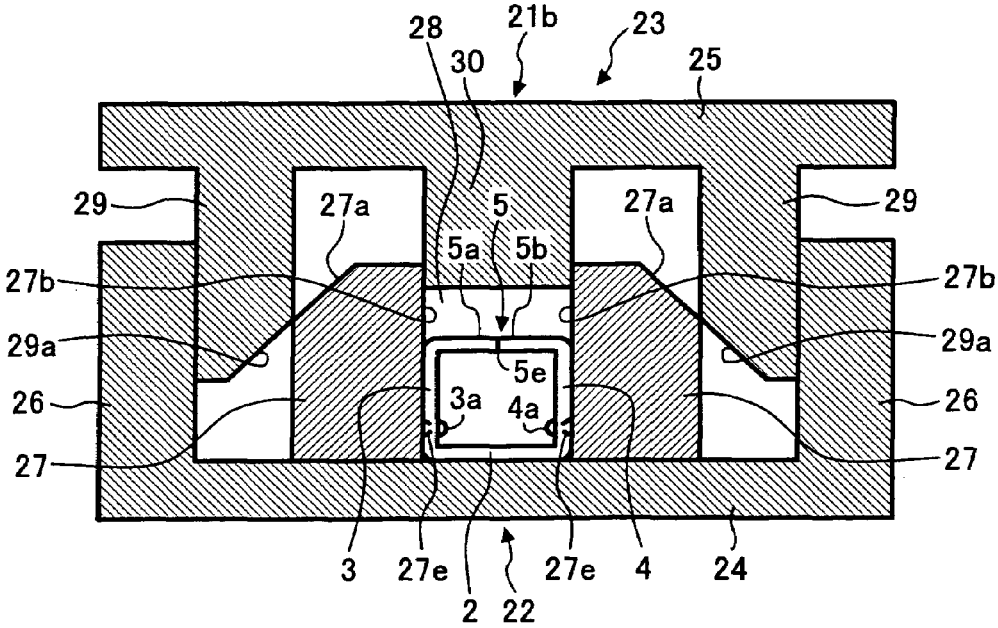
FIG. 27 is a schematic view showing a state that the press punching members stop moving in the press forming device of FIG. 25.
Figure 28:
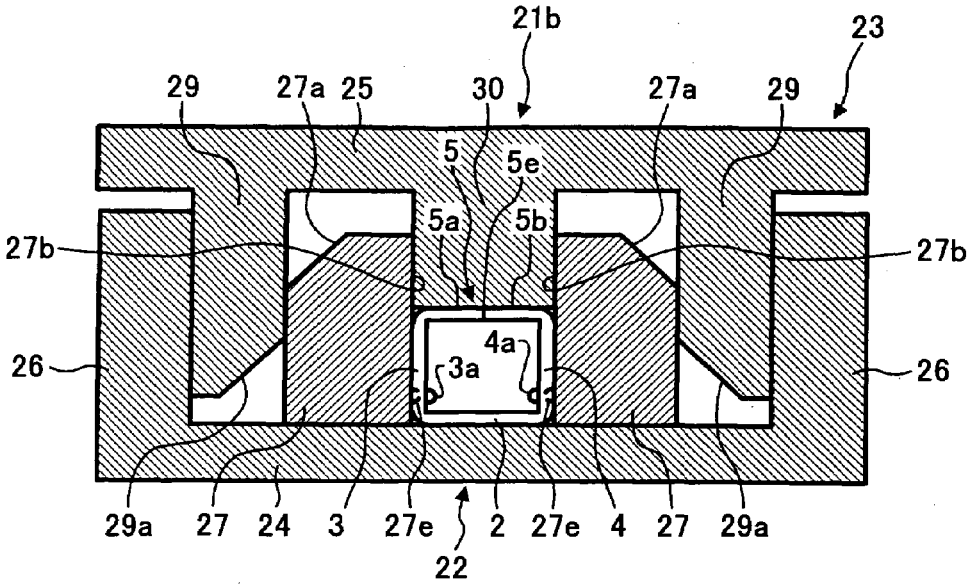
FIG. 28 is a schematic view showing a state that another press punching member presses an upper wall of the secondary intermediate product in the press forming device of FIG. 25.
Figure 29:
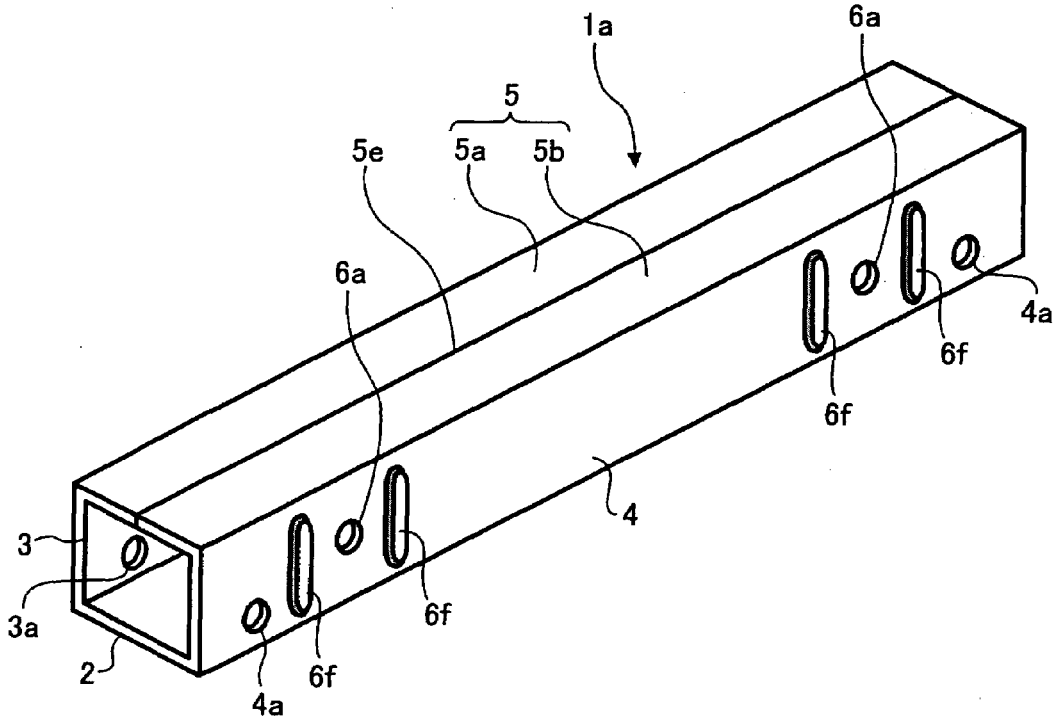
FIG. 29 is a schematic perspective view of a pipe body according to another embodiment of the present invention.
Figure 30:
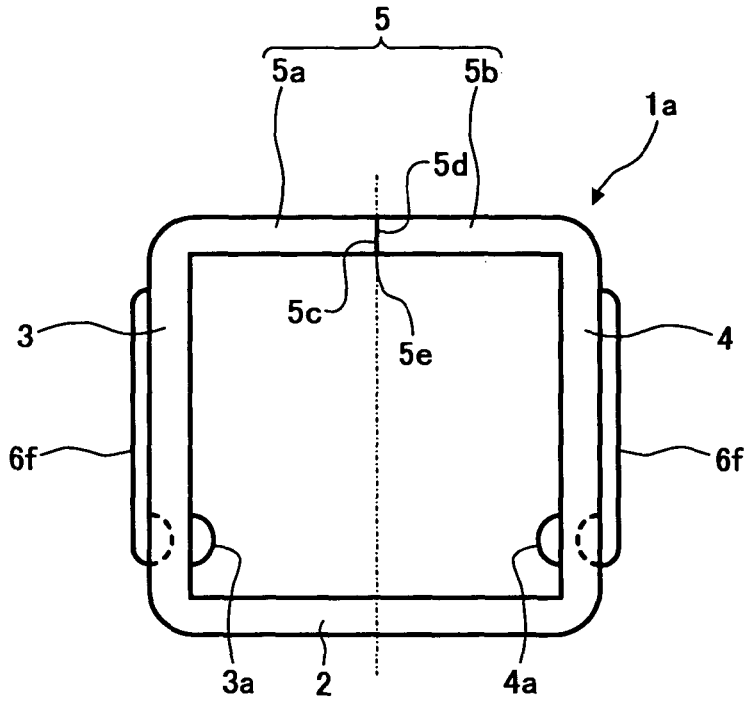
FIG. 30 is a side view of the pipe body of FIG. 29.

When the press punching members 27 are moved in the direction approaching toward each other, the end surfaces 5*c* and 5*d* of the walls 5*a* and 5*b* approach toward each other while the curved portion of the wall 15 is being straightened, and are brought into intimate contact with each other. As a result, the upper wall 5 of the pipe body 1*a* is formed. In this condition, the curved portions 31*a* and 31*b* slide upward along the punching surfaces 27*b*, and thereby the adjoining walls 16*a* and 16*b* stand up, and the side walls 3 and 4 of the pipe body 1*a* are formed. Further, the wall 15 abuts against the fixed plate 24 and receives the reactive force from the fixed plate 24. Finally, the wall 15 becomes the flat bottom wall 2 of the pipe body 1*a* as illustrated in FIG. 27. Moreover, as illustrated in FIGS. 29 and 30, convex portions 3*a* and 4*a* that protrude from the side walls 3 and 4 toward the inner side of the pipe body 1*a*, respectively, are formed by the protrusions 27*e*.

In the fourth processing step, when the upper mold 23 further descends, the taper portions 27*a* of the press punching members 27 and the taper portions 29*a* of the driving members 29 engaging each other are released. As a result, the press punching members 27 are stopped. When the upper mold 23 further descends in this condition, the press punching member 30 contacts and presses the upper wall 5. As a result, the bottom wall 2 and the upper wall 5 become more planar.

Figure 31:
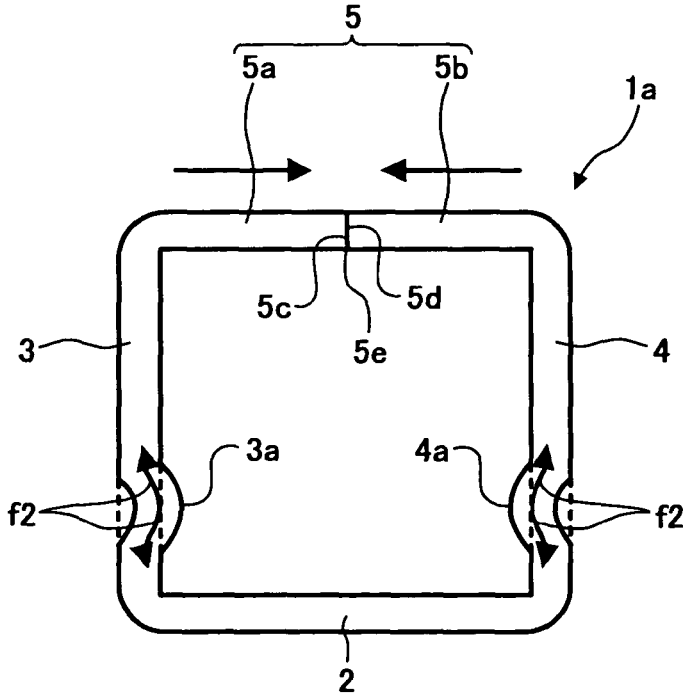
FIG. 31 is a schematic view for explaining a spring back force produced in the pipe body of FIGS. 29 and 30.

Further, when the upper mold 23 and the lower mold 22 are separated from each other while raising the upper mold 23, the pair of press punching members 27 move in the direction away from each other again. Finally, the pipe body 1*a* illustrated in FIGS. 29 and 30 is obtained as a completed product. The convex portions 3*a* and 4*a* of the pipe body 1*a* tend to return to the shape illustrated by the chain line in FIG. 31 by a spring back force (f2) generated at the positions in the side walls 3 and 4 where the convex portions 3*a* and 4*a* are formed. The spring back force (f2) remaining at the side walls 3 and 4 maintains the end surfaces 5*c* and 5*d* of the wall 5 in close contacted condition.

Similarly as in the above-described embodiments, in the manufacturing method of the pipe body 1 according to another embodiment, even when an external force is applied to the upper wall 5 of the pipe body 1, the deformation of the side walls 3 and 4 of the pipe body 1 and the deformation of the tapped holes 6*a* in the side walls 3 and 4 are prevented as the malleable portions 6*f* absorb the external force.

Figure 32:
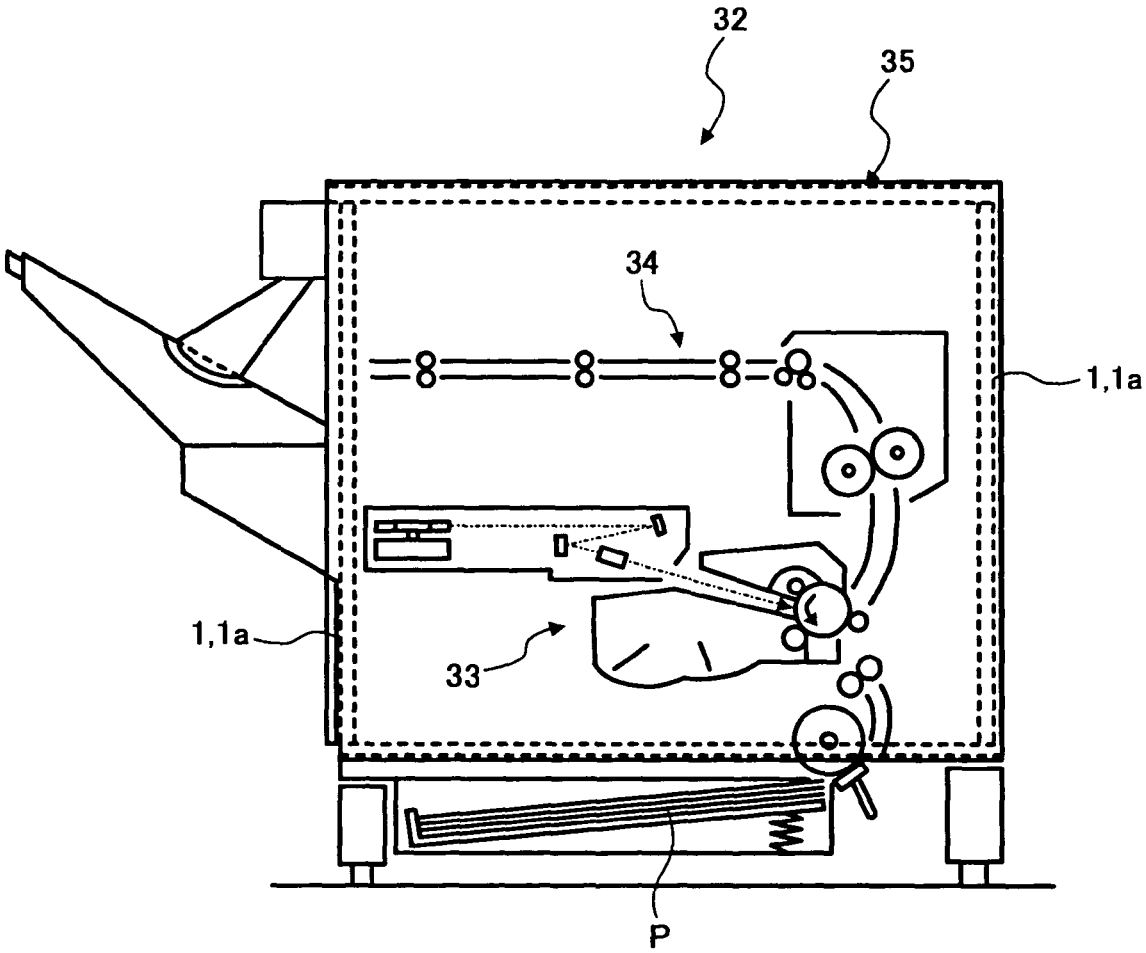
FIG. 32 is a schematic view of an image forming apparatus using the pipe body according to the embodiments of the present invention as a frame.

Next, another embodiment of the present invention will be described referring to FIG. 32. FIG. 32 is a schematic view of an image forming apparatus using the pipe body 1 or 1*a* as a frame. As illustrated in FIG. 32, an image forming apparatus 32 includes an image forming section 33 that forms images on a transfer material such as a sheet (P), a sheet conveying section 34 that conveys the sheet (P) on which images are formed, and a frame 35 that supports the image forming section 33 and the sheet conveying section 34. The image forming apparatus 32 uses the pipe body 1 or 1*a* as the frame 35, and thereby the overall cost of the image forming apparatus 32 is reduced.

Hereafter, specific examples showing the effects of the malleable portions 6*f* will be described.

Figure 33:
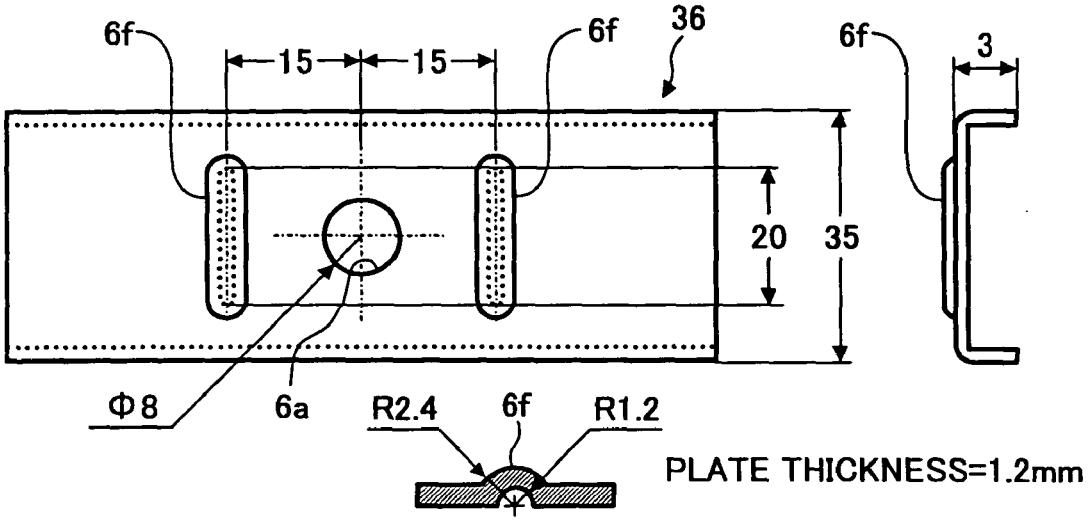
FIG. 33 is a schematic view of a plate body used in an analysis model of a deformation amount and a stress distortion according to an example.
Figure 34:
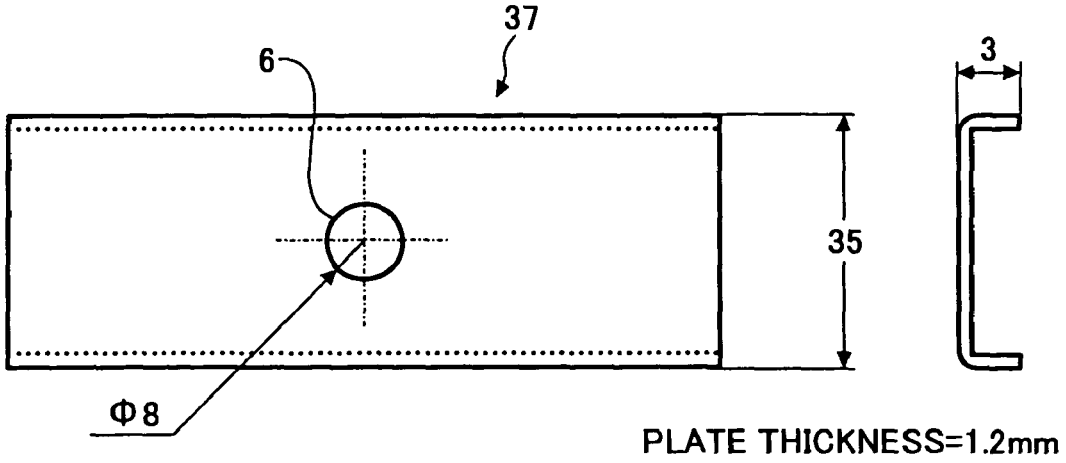
FIG. 34 is a schematic view of a plate body used in another analysis model of a deformation amount and a stress distortion according to a comparative example.
Figure 35A:
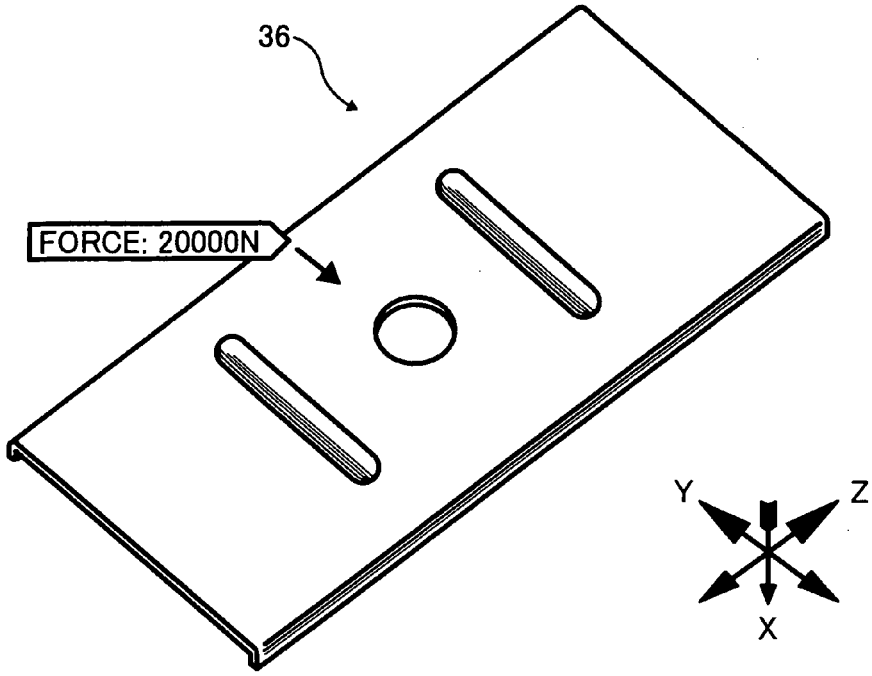
FIG. 35A is a view for explaining a state that load is applied to one end side of the plate body of FIG. 33.
Figure 35B:
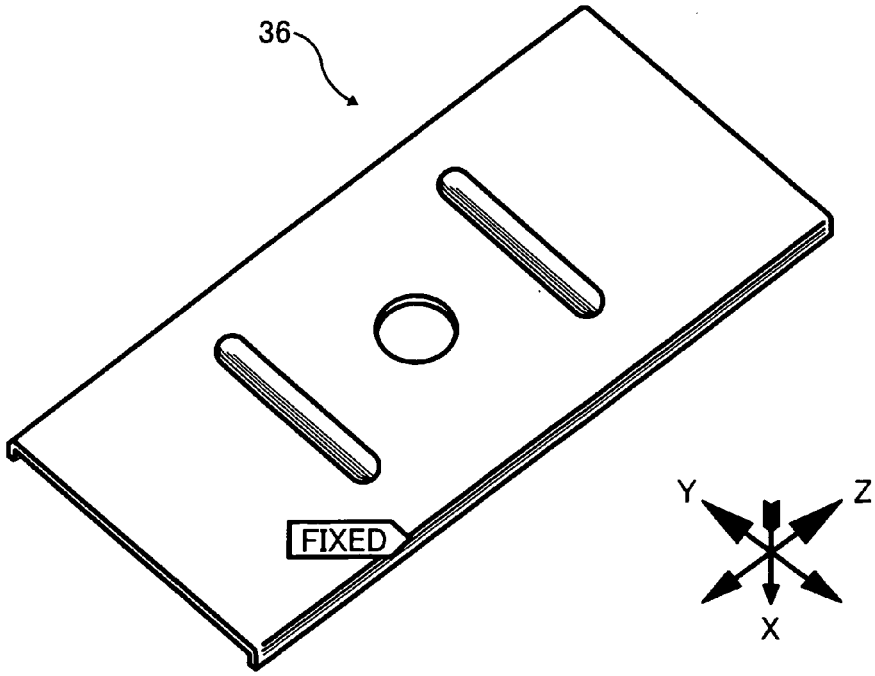
FIG. 35B is a view for explaining a state that the other end side of the plate body of FIG. 33 is fixed.
Figure 36A:
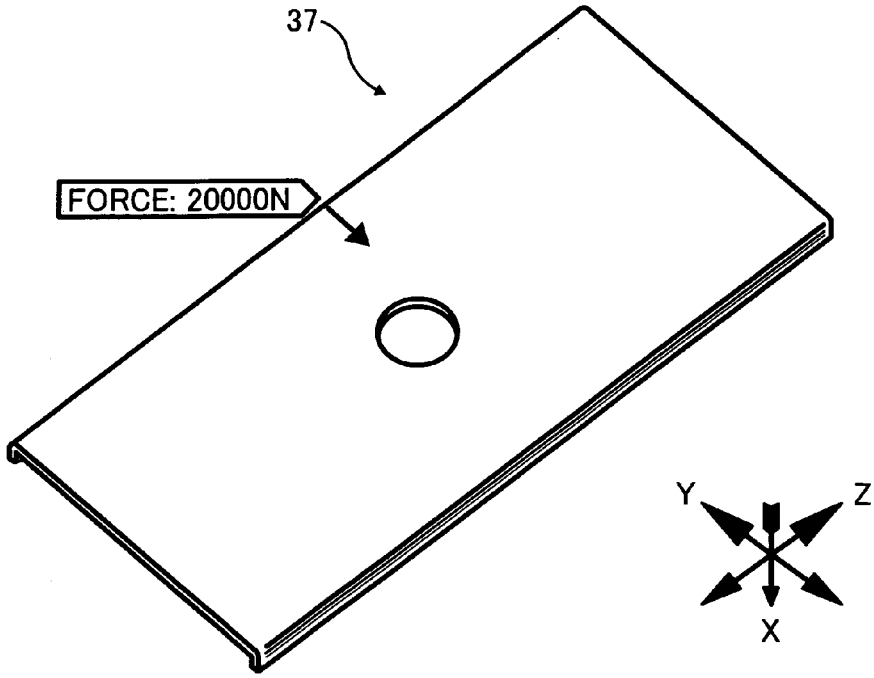
FIG. 36A is a view for explaining a state that load is applied to one end side of the plate body of FIG. 34.
Figure 36B:
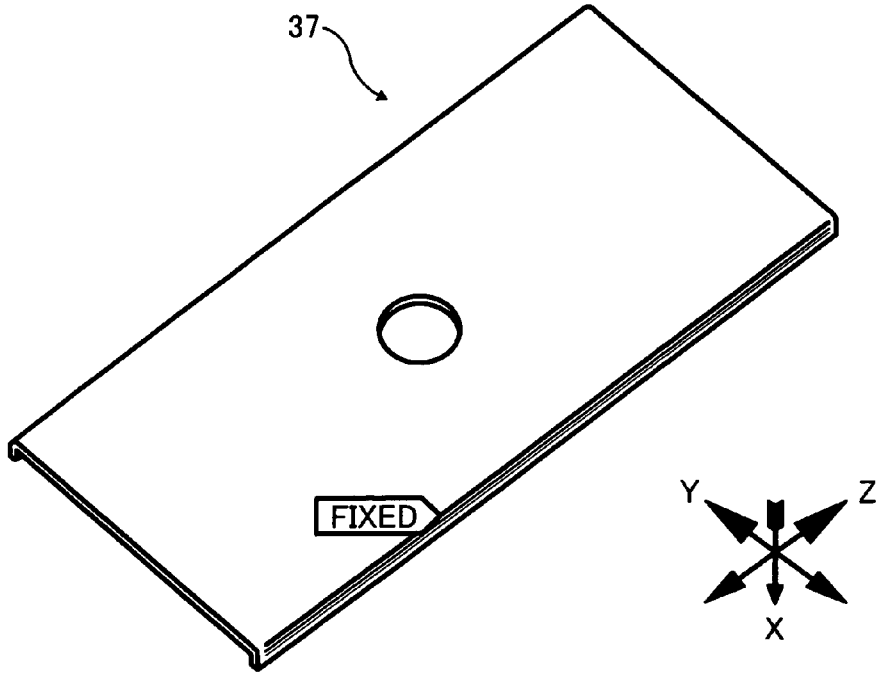
FIG. 36B is a view for explaining a state that the other end side of the plate body of FIG. 34 is fixed.

FIG. 33 is a schematic view of a plate body 36 used in an analysis model of a deformation amount and a stress distortion according to an example. FIG. 34 is a schematic view of a plate body 37 used in another analysis model of a deformation amount and a stress distortion according to a comparative example. Referring to FIG. 33, the plate body 36 corresponds to the part of the adjoining wall 16*a* or 16*b* including a tapped hole 6*a* having a diameter of about 8 mm and malleable portions 6*f*. The malleable portion 6*f* is formed by a bead processing and includes a convex portion with curvature radius R2.4 and a concave portion with curvature radius R1.2. As illustrated in FIG. 33, the distance between the center of the tapped hole 6*a* and the center of the malleable portion 6*f* is about 15 mm. The longitudinal length of the malleable portion 6*f* is about 20 mm. The width of the plate body 36 is about 35 mm. The height of the plate body 36 is about 3 mm. The plate thickness of the plate body 36 is about 1.2 mm.

Referring to FIG. 34, the plate body 37 is similar to the plate body 36 except that the plate body 37 does not include a malleable portion. As illustrated in FIG. 34, the plate body 37 includes a tapped hole 6*a* having a diameter of about 8 mm. The width of the plate body 37 is about 35 mm, and the height of the plate body 37 is about 3 mm. The plate thickness of the plate body 37 is about 1.2 mm.

As illustrated in FIGS. 35A and 35B and FIGS. 36A and 36B, the load of 20 kN is applied to one end side (i.e., on the side of the upper wall 5 of the pipe body 1) of each of the plate bodies 36 and 37 under the condition that the other end side (i.e., on the side of the bottom wall 2 of the pipe body 1) thereof is fixed. For the deformation amount analyses and the stress distribution analyses of the plate bodies 36 and 37, an analysis software sold under the trademark DesignSpace ver.6 made by ANSYS INC. was used. The analysis results are shown in FIGS. 37 through 40.

Figure 37:
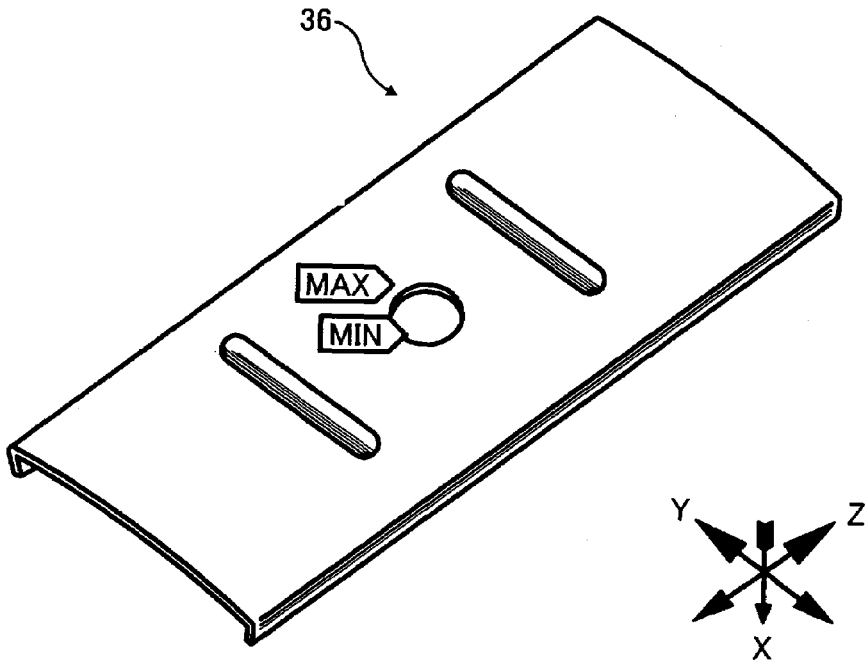
FIG. 37 is a view showing a deformation amount of the plate body of FIG. 33.

FIG. 37 shows the deformation amount of the plate body 36 along the load direction at various portions of the circumferential surface of the tapped hole 6*a*. The upper portion of the cylindrical-shaped circumferential surface of the tapped hole 6*a* (on the front side of the plate body 36 in FIG. 37) is deformed by $0.074\times10^{-3}$ m or greater in the Y direction in FIG. 37 (i.e., expansion). The maximum deformation amount is $0.109\times10^{-3}$ m at the position of the tapped hole 6*a* indicated by the character "Max" in FIG. 37. The lower portion of the cylindrical-shaped circumferential surface of the tapped hole 6*a* (on the rear side of the plate body 36 in FIG. 37) is deformed by $-0.170\times10^{-3}$ m or greater in the Y direction in FIG. 37 (i.e., contraction). The negative maximum deformation amount is $-0.205\times10^{-3}$ m at the position of the tapped hole 6*a* indicated by the character "Min" in FIG. 37.

Figure 38:
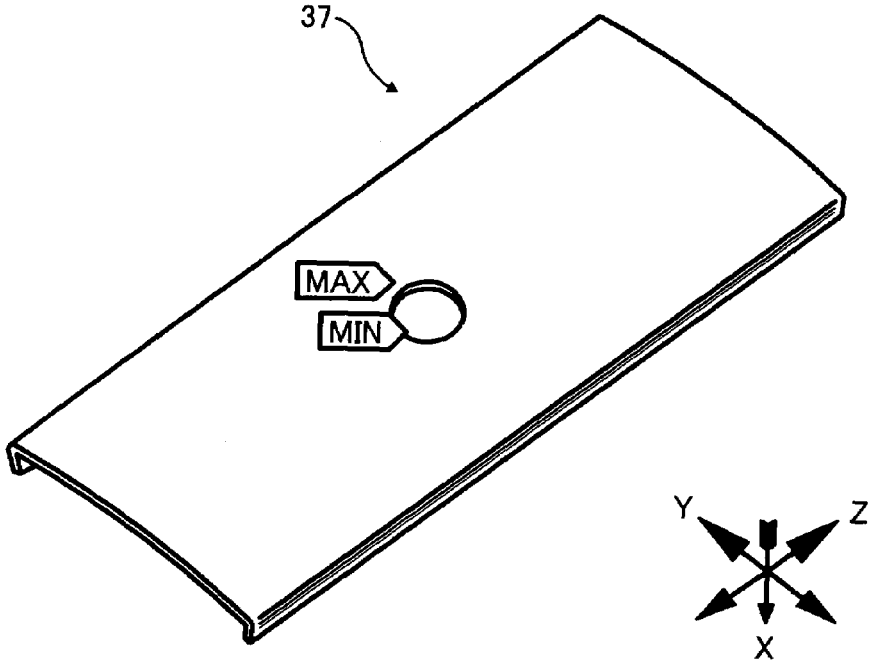
FIG. 38 is a view showing a deformation amount of the plate body of FIG. 34.

FIG. 38 shows the deformation amount of the plate body 37 along the load direction at various portions of the circumferential surface of the tapped hole 6*a*. The upper portion of the cylindrical-shaped circumferential surface of the tapped hole 6*a* (on the front side of the plate body 37 in FIG. 38) is deformed by $0.174\times10^{-3}$ m or greater in the Y direction in FIG. 38 (i.e., expansion). The maximum deformation amount is $0.232\times10^{-3}$ m at the position of the tapped hole 6*a* indicated by the character "Max" in FIG. 38. The lower portion of the cylindrical-shaped circumferential surface of the tapped hole 6*a* (on the rear side of the plate body 37 in FIG. 38) is deformed by $-0.229\times10^{-3}$ m or greater in the Y direction in FIG. 38 (i.e., contraction). The negative maximum deformation amount is $-0.287\times10^{-3}$ m at the position of the tapped hole 6*a* indicated by the character "Min" in FIG. 38.

Figure 39:
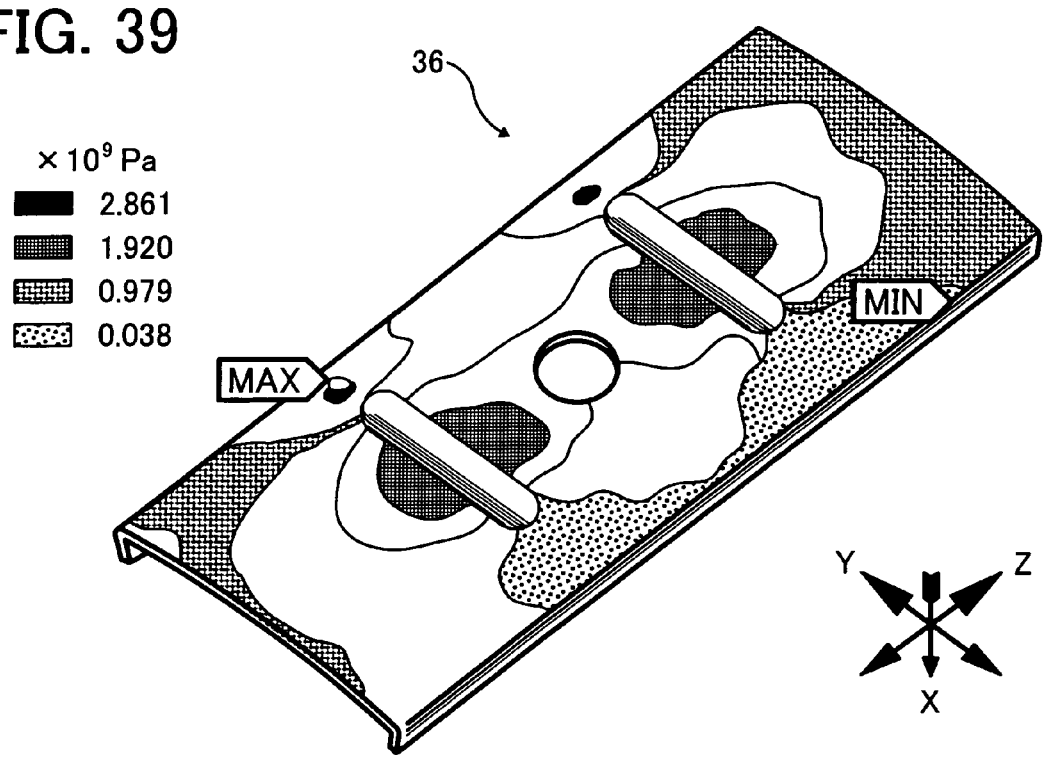
FIG. 39 is a view showing stress distribution of the plate body of FIG. 33.

FIG. 39 shows the stress distribution of the plate body 36. The stress distribution of the plate body 36 is relatively high at the malleable portions 6*f* and the portion of the plate body 36 adjacent to the malleable portions 6*f* along the Y direction. The stress of $1.920\times10^{9}$ Pa or greater is exerted in the stress concentration area. The maximum stress is $2.861\times10^{9}$ Pa at the position of the plate body 36 indicated by the character "Max" in FIG. 39. The stress exerted around the tapped hole 6 is $0.979\times10^{9}$ Pa or less, and the stress exerted at the above-described other end fixed side of the plate body 36 is $0.666\times10^{9}$ Pa or less. The minimum stress measured is $0.038\times10^{9}$ Pa at the position of the plate body 36 indicated by the character "Min" in FIG. 39.

Figure 40:
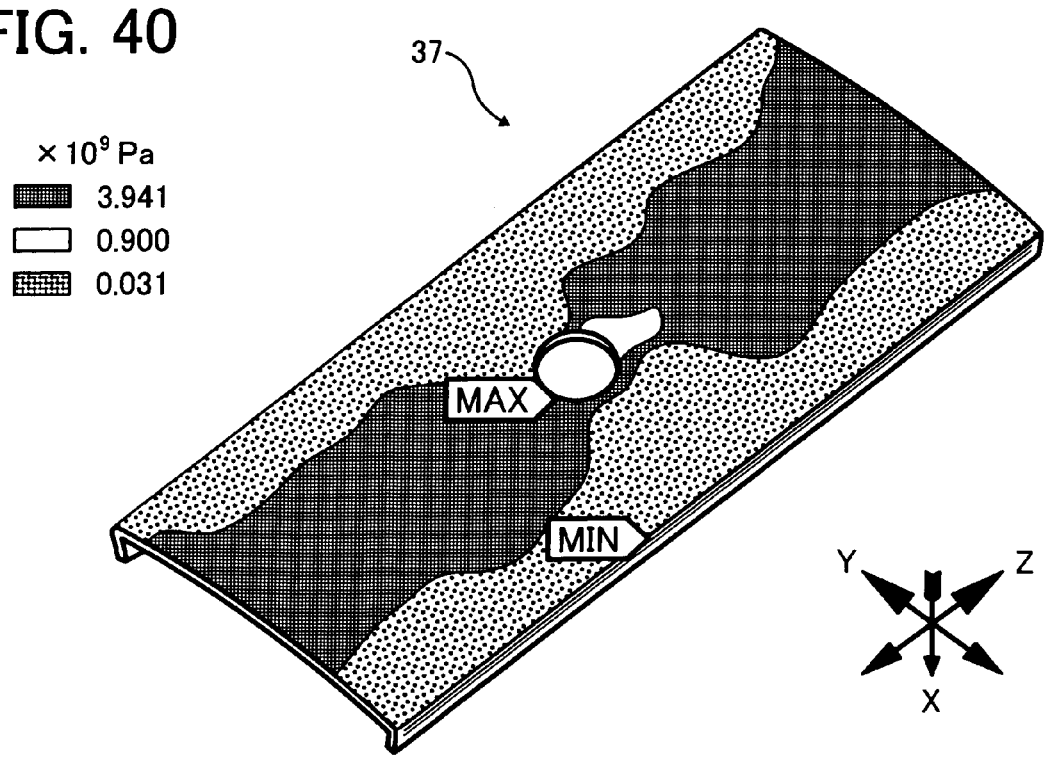
FIG. 40 is a view showing stress distribution of the plate body of FIG. 34.

FIG. 40 shows the stress distribution of the plate body 37. The stress distribution of the plate body 37 is relatively high around the tapped hole 6*a*, specifically, the stress of $1.769\times10^{9}$ Pa or greater is exerted in this area. The maximum stress is $3.941\times10^{9}$ Pa at the position of the plate body 37 indicated by the character "Max" in FIG. 40. The stress exerted at the above-described other end fixed side of the plate body 37 is $0.900\times10^{9}$ Pa or less. The minimum stress measured is $0.031\times10^{9}$ Pa at the position of the plate body 37 indicated by the character "Min" in FIG. 40.

The deformation amount analyses and the stress distribution analyses of the plate bodies 36 and 37 were performed while changing the values of load applied to the plate bodies 36 and 37, such as, 10 kN, 5 kN, and 3 kN. Then, each of the difference between the positive maximum deformation amount and the negative maximum deformation amount of the plate bodies 36 and 37 was calculated. The calculation results of the difference (M1) of the plate body 36 and the difference (M2) of the plate body 37 are shown in Table 1 and FIG. 41.

TABLE 1

| (Positive Maximum deformation amount) − (Negative Maximum deformation amount) | | | | |
|---|---|---|---|---|
| | Load (kN) | | | |
| | 3 | 5 | 10 | 20 |
| M1 | 0.0472 mm | 0.0786 mm | 0.158 mm | 0.314 mm |
| M2 | 0.0778 mm | 0.1296 mm | 0.259 mm | 0.519 mm |

Figure 41:
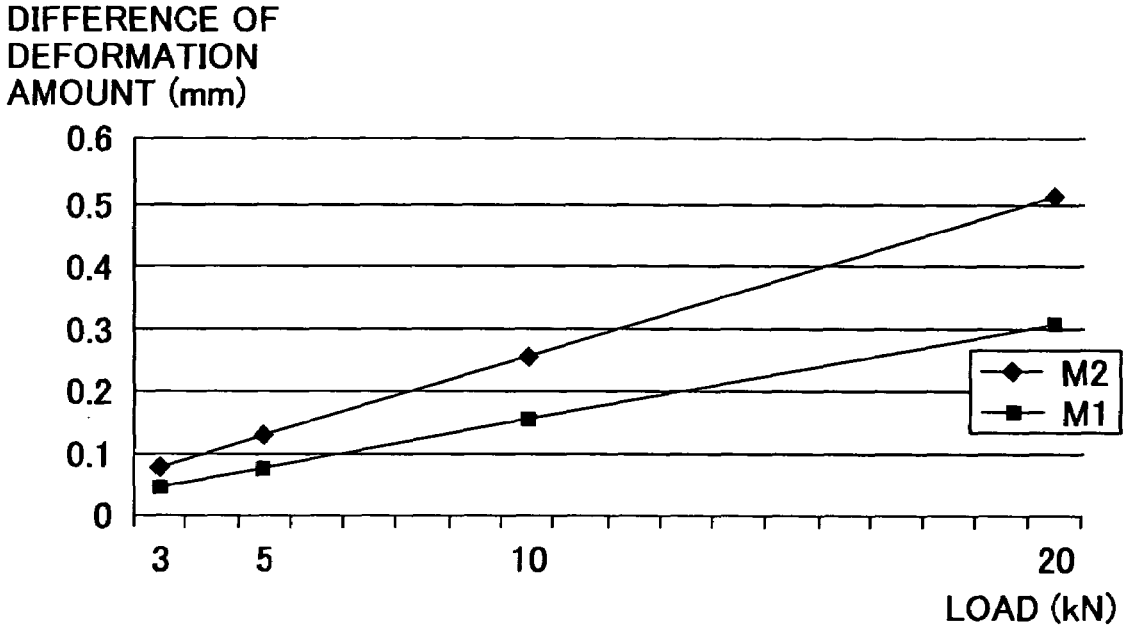
FIG. 41 is a graph showing a relationship between a difference of deformation amount and load of each of the plate bodies of FIGS. 33 and 34.

As seen from the Table 1 and FIG. 41, when the malleable portions 6*f* are formed in the plate body 36, the deformation of the plate body 36 increases more gradually relative to the load and the deformation amount at the circumferential surface of the tapped hole 6*a* in the plate body 36 is less as compared to the plate body 37 without a malleable portion. As seen from FIG. 40, the stress is concentrated at the circumferential surface of the tapped hole 6*a*. In FIG. 39, the stress around the tapped hole 6*a* is suppressed while the malleable portions 6*f* absorb the stress. From the above-described results, it is shown that the malleable portions 6*f* effectively function when manufacturing a pipe body with high accuracy.

The present invention has been described with respect to the embodiments as illustrated in the figures. However, the present invention is not limited to the embodiments and may be practiced otherwise. For example, in the above-described embodiments, the malleable portions 6*f* protrude from the surface of the metal plate 6 such that the malleable portions 6*f* project outward from the pipe body 1. Alternatively, the malleable portions 6*f* may protrude inward from the surface of the pipe body 1. In this case, when external forces are applied to the adjoining walls 16*a* and 16*b* from press punching members in a press forming device, the malleable portions 6*f* do not interfere with the press punching members. Further, any modification need not be made to the press punching members to avoid the interference with the malleable portions 6*f*. Moreover, because the malleable portions 6*f* do not protrude outward from the completed pipe body 1, when the side walls 3 and 4 of the pipe body 1 constructed from the adjoining walls 16*a* and 16*b* is brought into contact with another member in an image forming apparatus, the malleable portions 6*f* do not interfere with the side walls 3 and 4 contacting with another member.

So long as the malleable portions 6*f* are made to absorb external forces, the malleable portions 6*f* need not be formed by a bead processing, need not extend in the direction perpendicular to the bending lines 6*c* and 6*d*, and need not be formed separately across each of the tapped holes 6*a* in the extending direction of the bending lines 6*c* and 6*d*. However, by forming the malleable portions 6*f* in the direction perpendicular to the bending lines 6*c* and 6*d*, the adjoining walls 16*a* and 16*b* are effectively reinforced. Further, by forming the malleable portions 6*f* separately across each of the tapped holes 6*a* in the extending direction of the bending lines 6*c* and 6*d*, the tapped holes 6*a* are prevented from deformation.

Numerous additional modifications and variations of the present invention are possible in light of the above teachings. It is therefore to be understood that within the scope of the appended claims, the present invention may be practiced otherwise than as specifically described herein.

What is claimed:

1. A pipe body having a rectangular cross section, comprising a metal plate having a pair of edges parallel to each other and a plurality of bending lines parallel to the pair of edges, wherein: the metal plate further comprises at least one malleable portion extending in a direction perpendicular to the bending lines of the metal plate; the metal plate is bent at the plurality of bending lines such that the metal plate includes a center bottom wall, first and second adjoining walls adjoining the center bottom wall, and two upper walls including the edges of the metal plate, respectively; the pair of edges in the two upper walls are brought into intimate contact with each other; and the at least one malleable portion is formed in at least one of the first and second adjoining walls; the metal plate further comprises at least one hole formed in at least one of the first and second adjoining walls, the at least one hole being adjacent to the at least one malleable portion; the at least one malleable portion is formed at at least one side of the at least one hole; and the at least one malleable portion has a longitudinal length which is greater than a diameter of the at least one hole.

2. The pipe body according to claim 1, wherein the external force is applied to the center bottom wall by pressing the two upper walls of the intermediate product in which the edges are in intimate contact with each other.

3. The pipe body according to claim 1, wherein the at least one malleable portion is formed by a bead processing.

4. The pipe body according to claim 1, wherein: the metal plate is formed into an intermediate product by bending the metal plate at the plurality of bending lines such that the intermediate product includes the center bottom wall, first and second adjoining walls adjoining the center bottom wall, and two upper walls including the edges of the metal plate, respectively, the center bottom wall and first and second adjoining walls forming obtuse angles, respectively, the pair of edges in the two upper walls being spaced apart from each other; external forces are applied to the first and second adjoining walls so as to expand and curve the center bottom wall outward, thereby bringing the pair of edges in the two upper walls into intimate contact with each other; and an external force is applied to the center bottom wall so as to flatten the center bottom wall and maintain the edges in the two upper walls in close contacted condition with a spring back force in the center bottom wall, thereby forming a pipe body having a bottom wall, two side walls, and an upper wall.

5. The pipe body according to claim 1, wherein the metal plate is formed into an intermediate product by bending the metal plate at the plurality of bending lines such that the intermediate product includes a center bottom wall, first and second adjoining walls adjoining the center bottom wall, and two upper walls including the edges of the metal plate, respectively, the center bottom wall and first and second adjoining walls forming obtuse angles, respectively, the pair of edges in the two upper walls being spaced apart from each other; external forces are applied to the first and second adjoining walls while inhibiting the center bottom wall from expanding and curving outward, thereby flattening the center bottom wall and bringing the pair of edges in the two upper walls into intimate contact with each other; and the two upper walls of the intermediate product in which the edges are in intimate contact with each other and the center bottom wall of the intermediate product are pressed, thereby forming a pipe body having a bottom wall, two side walls, and an upper wall.

6. The pipe body according to claim 1, wherein the metal plate is formed into an intermediate product by bending the metal plate at the plurality of bending lines such that the intermediate product includes a center bottom wall, first and second adjoining walls adjoining the center bottom wall, and two upper walls including the edges of the metal plate, respectively, the center bottom wall and first and second adjoining walls forming substantially right angles, respectively, the pair of edges in the two upper walls being spaced apart from each other; external forces are applied to the first and second adjoining walls while forming convex portions protruding from the first and second adjoining walls toward an inner side of the pipe body, respectively, thereby bringing the pair of edges in the two upper walls into intimate contact with each other; and the two upper walls of the intermediate product in which the edges are in intimate contact with each other and the center bottom wall of the intermediate product are pressed, thereby forming a pipe body having a bottom wall, two side walls, and an upper wall.

7. A pipe body having a rectangular cross section, comprising a metal plate having a pair of edges parallel to each other and a plurality of bending lines parallel to the pair of edges, wherein: the metal plate further comprises at least one malleable portion extending in a direction perpendicular to the bending lines of the metal plate; the metal plate is bent at the plurality of bending lines such that the metal plate includes a center bottom wall, first and second adjoining walls adjoining the center bottom wall, and two upper walls including the edges of the metal plate, respectively; the pair of edges in the two upper walls are brought into intimate contact with each other; the at least one malleable portion is formed in at least one of the first and second adjoining walls; and the at least one malleable portion protrudes outward from an outer surface of the at least one of the first and second adjoining walls.

8. The pipe body according to claim 7, wherein the at least one malleable portion is formed by a bead processing.

9. The pipe body according to claim 7, wherein: the metal plate is formed into an intermediate product by bending the metal plate at the plurality of bending lines such that the intermediate product includes the center bottom wall, first and second adjoining walls adjoining the center bottom wall, and two upper walls including the edges of the metal plate, respectively, the center bottom wall and first and second adjoining walls forming obtuse angles, respectively, the pair of edges in the two upper walls being spaced apart from each other; external forces are applied to the first and second adjoining walls so as to expand and curve the center bottom wall outward, thereby bringing the pair of edges in the two upper walls into intimate contact with each other; and an external force is applied to the center bottom wall so as to flatten the center bottom wall and maintain the edges in the two upper walls in close contacted condition with a spring back force in the center bottom wall, thereby forming a pipe body having a bottom wall, two side walls, and an upper wall.

10. The pipe body according to claim 7, wherein the metal plate is formed into an intermediate product by bending the metal plate at the plurality of bending lines such that the intermediate product includes a center bottom wall, first and second adjoining walls adjoining the center bottom wall, and two upper walls including the edges of the metal plate, respectively, the center bottom wall and first and second adjoining walls forming obtuse angles, respectively, the pair of edges in the two upper walls being spaced apart from each other; external forces are applied to the first and second adjoining walls while inhibiting the center bottom wall from expanding and curving outward, thereby flattening the center bottom wall and bringing the pair of edges in the two upper walls into intimate contact with each other; and the two upper walls of the intermediate product in which the edges are in intimate contact with each other and the center bottom wall of the intermediate product are pressed, thereby forming a pipe body having a bottom wall, two side walls, and an upper wall.

11. The pipe body according to claim 7, wherein the metal plate is formed into an intermediate product by bending the metal plate at the plurality of bending lines such that the intermediate product includes a center bottom wall, first and second adjoining walls adjoining the center bottom wall, and two upper walls including the edges of the metal plate, respectively, the center bottom wall and first and second adjoining walls forming substantially right angles, respectively, the pair of edges in the two upper walls being spaced apart from each other; external forces are applied to the first and second adjoining walls while forming convex portions protruding from the first and second adjoining walls toward an inner side of the pipe body, respectively, thereby bringing the pair of edges in the two upper walls into intimate contact with each other; and the two upper walls of the intermediate product in which the edges are in intimate contact with each other and the center bottom wall of the intermediate product are pressed, thereby forming a pipe body having a bottom wall, two side walls, and an upper wall.

* * * * *